US007954563B2

(12) United States Patent
Mock et al.

(10) Patent No.: US 7,954,563 B2
(45) Date of Patent: Jun. 7, 2011

(54) ROLLER LINK TOGGLE GRIPPER AND DOWNHOLE TRACTOR

(75) Inventors: Philip W. Mock, Costa Mesa, CA (US); N. Bruce Moore, Aliso Viejo, CA (US); Duane Bloom, Anaheim, CA (US)

(73) Assignee: WWT International, Inc., Anaheim, CA (US)

( * ) Notice: Subject to any disclaimer, the term of this patent is extended or adjusted under 35 U.S.C. 154(b) by 0 days.

(21) Appl. No.: 12/605,228

(22) Filed: Oct. 23, 2009

(65) Prior Publication Data

US 2010/0163251 A1 Jul. 1, 2010

Related U.S. Application Data

(63) Continuation of application No. 12/165,210, filed on Jun. 30, 2008, now Pat. No. 7,607,497, which is a continuation of application No. 11/083,115, filed on Mar. 17, 2005, now Pat. No. 7,392,859.

(60) Provisional application No. 60/554,169, filed on Mar. 17, 2004, provisional application No. 60/612,189, filed on Sep. 22, 2004.

(51) Int. Cl.
*E21B 4/18* (2006.01)

(52) U.S. Cl. ..... 175/99; 175/98; 166/212; 166/217

(58) Field of Classification Search ..... 175/97–99; 166/212, 217

See application file for complete search history.

(56) References Cited

U.S. PATENT DOCUMENTS

| | | | |
|---|---|---|---|
| 2,141,030 | A | 12/1938 | Clark |
| 2,167,194 | A | 7/1939 | Anderson |
| 2,271,005 | A | 1/1942 | Grebe |
| 2,569,457 | A | 10/1951 | Dale et al. |
| 2,727,722 | A | 12/1955 | Conboy |
| 2,946,565 | A | 7/1960 | Williams |
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |

(Continued)

FOREIGN PATENT DOCUMENTS

DE 2439063 2/1976

(Continued)

OTHER PUBLICATIONS

U.S. Appl. No. 12/776,232, entitled Tractor With Improved Valve System, filed May 7, 2010.

(Continued)

*Primary Examiner* — Giovanna C Wright

(74) *Attorney, Agent, or Firm* — Knobbe, Martens, Olson & Bear, LLP

(57) ABSTRACT

An expandable gripper assembly may be configured for anchoring a tool in a passage. The expandable gripper assembly includes first, second, and third pivotally connected links that are coupled to a tool. The third link is adapted to engage an inner wall in the passage. An actuation mechanism causes the third link to move radially outward from the tool for engagement with the inner wall. The actuation mechanism may comprise a roller mechanism that pushes on an inner surface of the first link for causing the first link to pivot outward away from the body. As the first and second links pivot outward, the third link moves in a radial direction for engagement with an inner wall.

7 Claims, 16 Drawing Sheets

U.S. PATENT DOCUMENTS

| | | | |
|---|---|---|---|
| 3,224,734 | A | 12/1965 | Hill |
| 3,225,843 | A | 12/1965 | Ortloff et al. |
| 3,376,942 | A | 4/1968 | Van Winkle |
| 3,497,019 | A | 2/1970 | Ortloff |
| 3,599,712 | A | 8/1971 | Magill |
| 3,606,924 | A | 9/1971 | Malone |
| 3,661,205 | A | 5/1972 | Belorgey |
| 3,664,416 | A | 5/1972 | Nicolas et al. |
| 3,797,589 | A | 3/1974 | Kellner et al. |
| 3,827,512 | A | 8/1974 | Edmond |
| RE28,449 | E | 6/1975 | Edmond |
| 3,941,190 | A | 3/1976 | Conover |
| 3,978,930 | A | 9/1976 | Schroeder |
| 3,992,565 | A | 11/1976 | Gatfield |
| 4,040,494 | A | 8/1977 | Kellner |
| 4,085,808 | A | 4/1978 | Kling |
| 4,095,655 | A | 6/1978 | Still |
| 4,141,414 | A | 2/1979 | Johansson |
| 4,314,615 | A | 2/1982 | Sodder, Jr. et al. |
| 4,365,676 | A | 12/1982 | Boyadjieff et al. |
| 4,372,161 | A | 2/1983 | de Buda et al. |
| 4,385,021 | A | 5/1983 | Neeley |
| 4,440,239 | A | 4/1984 | Evans |
| 4,463,814 | A | 8/1984 | Horstmeyer et al. |
| 4,558,751 | A | 12/1985 | Huffaker |
| 4,573,537 | A | 3/1986 | Hirasuna et al. |
| 4,615,401 | A | 10/1986 | Garrett |
| 4,674,914 | A | 6/1987 | Wayman et al. |
| 4,686,653 | A | 8/1987 | Staron et al. |
| 4,811,785 | A | 3/1989 | Weber |
| 4,821,817 | A | 4/1989 | Cendre et al. |
| 4,854,397 | A | 8/1989 | Warren et al. |
| 4,951,760 | A | 8/1990 | Cendre et al. |
| 5,010,965 | A | 4/1991 | Schmelzer |
| 5,052,211 | A | 10/1991 | Cohrs et al. |
| 5,090,259 | A | 2/1992 | Shishido et al. |
| 5,169,264 | A | 12/1992 | Kimura |
| 5,184,676 | A | 2/1993 | Graham et al. |
| 5,186,264 | A | 2/1993 | du Chaffaut |
| 5,203,646 | A | 4/1993 | Landsberger et al. |
| 5,310,012 | A | 5/1994 | Cendre et al. |
| 5,363,929 | A | 11/1994 | Williams et al. |
| 5,419,405 | A | 5/1995 | Patton |
| 5,425,429 | A | 6/1995 | Thompson |
| 5,449,047 | A | 9/1995 | Schivley, Jr. |
| 5,467,832 | A | 11/1995 | Orban et al. |
| 5,519,668 | A | 5/1996 | Montaron |
| 5,542,253 | A | 8/1996 | Ganzel |
| 5,613,568 | A | 3/1997 | Sterner et al. |
| 5,622,231 | A | 4/1997 | Thompson |
| 5,752,572 | A | 5/1998 | Baiden et al. |
| 5,758,731 | A | 6/1998 | Zollinger |
| 5,758,732 | A | 6/1998 | Liw |
| 5,765,640 | A | 6/1998 | Milne et al. |
| 5,794,703 | A | 8/1998 | Newman et al. |
| 5,803,193 | A | 9/1998 | Krueger et al. |
| 5,845,796 | A | 12/1998 | Miller |
| 5,857,731 | A | 1/1999 | Heim et al. |
| 5,947,213 | A | 9/1999 | Angle et al. |
| 5,954,131 | A | 9/1999 | Salwasser |
| 5,960,895 | A | 10/1999 | Chevallier et al. |
| 5,996,979 | A | 12/1999 | Hrsuch |
| 6,003,606 | A | 12/1999 | Moore et al. |
| 6,026,911 | A | 2/2000 | Angle et al. |
| 6,031,371 | A | 2/2000 | Smart |
| 6,089,323 | A | 7/2000 | Newman et al. |
| 6,112,809 | A | 9/2000 | Angle |
| 6,230,813 | B1 | 5/2001 | Moore et al. |
| 6,241,031 | B1 | 6/2001 | Beaufort et al. |
| 6,273,189 | B1 | 8/2001 | Gissler et al. |
| 6,286,592 | B1 | 9/2001 | Moore et al. |
| 6,315,043 | B1 | 11/2001 | Farrant et al. |
| 6,345,669 | B1 | 2/2002 | Buyers et al. |
| 6,347,674 | B1 | 2/2002 | Bloom et al. |
| 6,378,627 | B1 | 4/2002 | Tubel et al. |
| 6,427,786 | B2 | 8/2002 | Beaufort et al. |
| 6,431,291 | B1 | 8/2002 | Moore et al. |
| 6,464,003 | B2 | 10/2002 | Bloom et al. |
| 6,478,097 | B2 | 11/2002 | Bloom et al. |
| 6,601,652 | B1 | 8/2003 | Moore et al. |
| 6,640,894 | B2 | 11/2003 | Bloom et al. |
| 6,651,747 | B2 | 11/2003 | Chen et al. |
| 6,679,341 | B2 | 1/2004 | Bloom et al. |
| 6,715,559 | B2 | 4/2004 | Bloom et al. |
| 6,745,854 | B2 | 6/2004 | Bloom et al. |
| 6,758,279 | B2 | 7/2004 | Moore et al. |
| 6,827,149 | B2 | 12/2004 | Hache |
| 6,868,906 | B1 | 3/2005 | Vail, III et al. |
| 6,910,533 | B2 | 6/2005 | Guerrero |
| 6,920,936 | B2 | 7/2005 | Sheiretov et al. |
| 6,938,708 | B2 | 9/2005 | Bloom et al. |
| 6,953,086 | B2 | 10/2005 | Simpson |
| 7,048,047 | B2 | 5/2006 | Bloom et al. |
| 7,059,417 | B2 | 6/2006 | Moore et al. |
| 7,080,700 | B2 | 7/2006 | Bloom et al. |
| 7,080,701 | B2 | 7/2006 | Bloom et al. |
| 7,121,364 | B2 | 10/2006 | Mock et al. |
| 7,156,181 | B2 | 1/2007 | Moore et al. |
| 7,174,974 | B2 | 2/2007 | Bloom et al. |
| 7,185,716 | B2 | 3/2007 | Bloom et al. |
| 7,188,681 | B2 | 3/2007 | Bloom et al. |
| 7,191,829 | B2 | 3/2007 | Bloom et al. |
| 7,222,682 | B2 | 5/2007 | Doering et al. |
| 7,273,109 | B2 | 9/2007 | Moore et al. |
| 7,275,593 | B2 | 10/2007 | Bloom et al. |
| 7,303,010 | B2 | 12/2007 | de Guzman et al. |
| 7,343,982 | B2 | 3/2008 | Mock et al. |
| 7,353,886 | B2 | 4/2008 | Bloom et al. |
| 7,392,859 | B2 | 7/2008 | Mock et al. |
| 7,401,665 | B2 | 7/2008 | Guerrero et al. |
| 7,493,967 | B2 | 2/2009 | Mock et al. |
| 7,516,782 | B2 | 4/2009 | Sheiretov et al. |
| 7,516,792 | B2 | 4/2009 | Lonnes et al. |
| 7,604,060 | B2 | 10/2009 | Bloom et al. |
| 7,607,495 | B2 | 10/2009 | Bloom et al. |
| 7,607,497 | B2 | 10/2009 | Mock et al. |
| 7,624,808 | B2 | 12/2009 | Mock |
| 7,836,950 | B2 | 11/2010 | Vail, III et al. |
| 2001/0045300 | A1 | 11/2001 | Fincher et al. |
| 2002/0032126 | A1 | 3/2002 | Kusmer |
| 2002/0079107 | A1 | 6/2002 | Simpson |
| 2002/0088648 | A1 | 7/2002 | Krueger et al. |
| 2003/0024710 | A1 | 2/2003 | Post et al. |
| 2003/0150609 | A1 | 8/2003 | Stoesz |
| 2003/0183383 | A1 | 10/2003 | Guerrero |
| 2005/0034874 | A1 | 2/2005 | Guerrero et al. |
| 2005/0145415 | A1 | 7/2005 | Doerling et al. |
| 2005/0217861 | A1 | 10/2005 | Misselbrook |
| 2006/0180318 | A1 | 8/2006 | Doering et al. |
| 2007/0056745 | A1 | 3/2007 | Contant |
| 2007/0095532 | A1 | 5/2007 | Head et al. |
| 2007/0181298 | A1 | 8/2007 | Sheiretov et al. |
| 2007/0256827 | A1 | 11/2007 | Guerrero et al. |
| 2007/0261887 | A1 | 11/2007 | Pai et al. |
| 2008/0061647 | A1 | 3/2008 | Schmitt |
| 2008/0066963 | A1 | 3/2008 | Sheiretov et al. |
| 2008/0073077 | A1 | 3/2008 | Tunc et al. |
| 2008/0110635 | A1 | 5/2008 | Loretz et al. |
| 2008/0149339 | A1 | 6/2008 | Krueger, V |
| 2008/0169107 | A1 | 7/2008 | Redlinger et al. |
| 2008/0196901 | A1 | 8/2008 | Aguirre et al. |
| 2008/0202769 | A1 | 8/2008 | Dupree et al. |
| 2008/0223573 | A1 | 9/2008 | Nelson et al. |
| 2008/0314639 | A1 | 12/2008 | Kotsonis et al. |
| 2009/0008150 | A1 | 1/2009 | Lavrut et al. |
| 2009/0025941 | A1 | 1/2009 | Iskander et al. |
| 2009/0071659 | A1 | 3/2009 | Spencer et al. |
| 2009/0071660 | A1 | 3/2009 | Martinez et al. |
| 2009/0301734 | A1 | 12/2009 | Tunc et al. |
| 2009/0321141 | A1 | 12/2009 | Kotsonis et al. |
| 2010/0018695 | A1 | 1/2010 | Bloom et al. |
| 2010/0018720 | A1 | 1/2010 | Mock |
| 2010/0038138 | A1 | 2/2010 | Mock et al. |
| 2010/0108387 | A1 | 5/2010 | Bloom et al. |
| 2010/0163251 | A1 | 7/2010 | Mock et al. |
| 2010/0263856 | A1 | 10/2010 | Lynde et al. |

FOREIGN PATENT DOCUMENTS

| | | | |
|---|---|---|---|
| DE | 2920049 | | 2/1987 |
| EP | 0 149 528 | A1 | 7/1985 |
| EP | 0 951 611 | B1 | 1/1993 |
| EP | 0 257 744 | B1 | 1/1995 |
| EP | 0 767 289 | A1 | 4/1997 |
| EP | 0911483 | | 4/1997 |
| EP | 1 281 834 | A | 2/2003 |
| EP | 1 344 893 | A2 | 9/2003 |
| EP | 1370891 | | 11/2006 |
| EP | 1223305 | | 4/2008 |
| GB | 894117 | | 4/1962 |
| GB | 1105701 | | 3/1968 |
| GB | 2 241 723 | A | 9/1991 |
| GB | 2 305 407 | | 4/1997 |
| GB | 2 310 871 | A | 9/1997 |
| GB | 2 346 908 | A | 8/2000 |
| GB | 2401130 | | 11/2004 |
| WO | WO 89/05391 | | 6/1989 |
| WO | WO 92/13226 | | 8/1992 |
| WO | WO 93/18277 | | 9/1993 |
| WO | WO 94/27022 | | 11/1994 |
| WO | WO 95/21987 | | 8/1995 |
| WO | WO 00/36266 | | 6/2000 |
| WO | WO 00/46461 | | 8/2000 |
| WO | WO 00/63606 | | 10/2000 |
| WO | WO 00/73619 | | 12/2000 |
| WO | WO 02/44509 | A2 | 6/2002 |
| WO | WO 2005/057076 | | 6/2005 |
| WO | WO 2007039025 | | 4/2007 |
| WO | WO 2007134748 | | 11/2007 |
| WO | WO 2008/104177 | | 9/2008 |
| WO | WO 2008/104178 | | 9/2008 |
| WO | WO 2008/104179 | | 9/2008 |
| WO | WO 2008/128542 | | 10/2008 |
| WO | WO 2008/128543 | | 10/2008 |
| WO | WO 2009/062718 | | 5/2009 |
| WO | WO 2010/062186 | | 6/2010 |

OTHER PUBLICATIONS

U.S. Appl. No. 60/201,353, and cover sheet, filed May 2, 2000 entitled "Borehole Retention Device" in 24 pages.

UK Search Report dated May 25, 2007 for Application GB0704656.8.

PCT International Search Report and Written Opinion of the ISA dated Jun. 16, 2005 for International Application No. PCT/US2005/008919.

PCT International Search Report and Written Opinion of the ISA dated Apr. 22, 2008 for International Application No. PCT/US2007/084574.

"Kilobomac to Challenge Tradition" Norwegian Oil Review, 1988, pp. 50-52.

ROLLER LINK TOGGLE GRIPPER AND DOWNHOLE TRACTOR

RELATED U.S. APPLICATION DATA

This application is a continuation of U.S. patent application Ser. No. 12/165,210, entitled "ROLLER LINK TOGGLE GRIPPER AND DOWNHOLE TRACTOR," filed on Jun. 30, 2008, now U.S. Pat. No. 7,607,497, which is a continuation of U.S. patent application Ser. No. 11/083,115, entitled "ROLLER LINK TOGGLE GRIPPER AND DOWNHOLE TRACTOR," filed on Mar. 17, 2005, now U.S. Pat. No. 7,392,859, which claims the benefit of U.S. Provisional Patent Application No. 60/554,169, entitled "ROLLER LINK TOGGLE GRIPPER," filed on Mar. 17, 2004 and U.S. Provisional Patent Application No. 60/612,189, entitled "ROLLER LINK TOGGLE GRIPPER," filed on Sep. 22, 2004.

Also, this application hereby incorporates by reference the above-identified applications, in their entirety.

BACKGROUND OF THE INVENTION

1. Field of the Invention

The present invention relates generally to gripping mechanisms for downhole tools.

2. Description of the Related Art

Tractors for moving within underground boreholes are used for a variety of purposes, such as oil drilling, mining, laying communication lines, and many other purposes. In the petroleum industry, for example, a typical oil well comprises a vertical borehole that is drilled by a rotary drill bit attached to the end of a drill string. The drill string may be constructed of a series of connected links of drill pipe that extend between ground surface equipment and the aft end of the tractor. Alternatively, the drill string may comprise flexible tubing or "coiled tubing" connected to the aft end of the tractor. A drilling fluid, such as drilling mud, is pumped from the ground surface equipment through an interior flow channel of the drill string and through the tractor to the drill bit. The drilling fluid is used to cool and lubricate the bit, and to remove debris and rock chips from the borehole, which are created by the drilling process. The drilling fluid returns to the surface, carrying the cuttings and debris, through the annular space between the outer surface of the drill pipe and the inner surface of the borehole.

Tractors for moving within downhole passages are often required to operate in harsh environments and limited space. For example, tractors used for oil drilling may encounter hydrostatic pressures as high as 16,000 psi and temperatures as high as 300° F. Typical boreholes for oil drilling are 3.5-27.5 inches in diameter. Further, to permit turning, the tractor length should be limited. Also, tractors must often have the capability to generate and exert substantial force against a formation. For example, operations such as drilling require thrust forces as high as 30,000 pounds.

As a result of the harsh working environment, space constraints, and desired force generation requirements, downhole tractors are used only in very limited situations, such as within existing well bore casing. While a number of the inventors of this application have previously developed a significantly improved design for a downhole tractor, further improvements are desirable to achieve performance levels that would permit downhole tractors to achieve commercial success in other environments, such as open bore drilling.

Western Well Tool, Incorporated has developed a variety of downhole tractors for drilling, completion and intervention processes for wells and boreholes. For example, the Puller-Thruster Tractor is a multi-purpose tractor (U.S. Pat. Nos. 6,003,606, 6,286,592, and 6,601,652) that can be used in rotary, coiled tubing and wireline operations. A method of moving is described in U.S. Pat. No. 6,230,813. The Electro-hydraulically Controlled Tractor (U.S. Pat. Nos. 6,241,031 and 6,427,786) defines a tractor that utilizes both electrical and hydraulic control methods. The Electrically Sequenced Tractor (U.S. Pat. No. 6,347,674) defines a sophisticated electrically controlled tractor. The Intervention Tractor (also called the Tractor with improved valve system, U.S. Pat. No. 6,679,341 and U.S. Patent Application Publication No. 2004/0168828) is preferably an all hydraulic tractor intended for use with coiled tubing that provides locomotion downhole to deliver heavy loads such as perforation guns and sand washing.

These various tractors are intended to provide locomotion, to pull or push various types of loads. For each of these various types of tractors, various types of gripper elements have been developed. Thus an important part of the downhole tractor tool is its gripper system.

In one known design, a tractor comprises an elongated body, a propulsion system for applying thrust to the body, and grippers for anchoring the tractor to the inner surface of a borehole or passage while such thrust is applied to the body. Each gripper has an actuated position in which the gripper substantially prevents relative movement between the gripper and the inner surface of the passage, and a retracted position in which the gripper permits substantially free relative movement between the gripper and the inner surface of the passage. Typically, each gripper is slidingly engaged with the tractor body so that the body can be thrust longitudinally while the gripper is actuated. The grippers preferably do not substantially impede "flow-by," the flow of fluid returning from the drill bit up to the ground surface through the annulus between the tractor and the borehole surface.

Tractors may have at least two grippers that alternately actuate and reset to assist the motion of the tractor. In one cycle of operation, the body is thrust longitudinally along a first stroke length while a first gripper is actuated and a second gripper is retracted. During the first stroke length, the second gripper moves along the tractor body in a reset motion. Then, the second gripper is actuated and the first gripper is subsequently retracted. The body is thrust longitudinally along a second stroke length. During the second stroke length, the first gripper moves along the tractor body in a reset motion. The first gripper is then actuated and the second gripper subsequently retracted. The cycle then repeats. Alternatively, a tractor may be equipped with only a single gripper for specialized applications of well intervention, such as movement of sliding sleeves or perforation equipment.

Grippers may be designed to be powered by fluid, such as drilling mud in an open tractor system or hydraulic fluid in a closed tractor system. Typically, a gripper assembly has an actuation fluid chamber that receives pressurized fluid to cause the gripper to move to its actuated position. The gripper assembly may also have a retraction fluid chamber that receives pressurized fluid to cause the gripper to move to its retracted position. Alternatively, the gripper assembly may have a mechanical retraction element, such as a coil spring or leaf spring, which biases the gripper back to its retracted position when the pressurized fluid is discharged. Motor-operated or hydraulically controlled valves in the tractor body can control the delivery of fluid to the various chambers of the gripper assembly.

The original design of the Western Well Tool Puller-Thruster Tractor incorporated the use of an inflatable reinforced rubber packer (i.e., "Packerfoot") as a means of anchoring the tool in the well bore. This original gripper concept was improved with various types of reinforcement in U.S. Pat. No. 6,431,291, entitled "Packerfoot Having Reduced Likelihood of Bladder Delamination." This concept developed a "Gripper" with an expansion diameter of approximately 1 inch. This design was susceptible to premature failure of the fiber terminations, subsequent delamination and pressure boundary failure. The second "Gripper" concept was the Roller Toe Gripper (U.S. Pat. No. 6,464,003). The current embodiment of this gripper works exceedingly well, however in one current embodiment, there are limits to the extent of diametrical expansion, thus limiting the well bore variations compatible with the "Gripper" anchoring. Historically, the average diametrical expansion has averaged approximately 2 inches.

Additionally, The prior art includes a variety of different types of grippers for tractors. One type of gripper comprises a plurality of frictional elements, such as metallic friction pads, blocks, or plates, which are disposed about the circumference of the tractor body. The frictional elements are forced radially outward against the inner surface of a borehole under the force of fluid pressure. However, these gripper designs are either too large to fit within the small dimensions of a borehole or have limited radial expansion capabilities. Also, the size of these grippers often cause a large pressure drop in the flow-by fluid, i.e., the fluid returning from the drill bit up through the annulus between the tractor and the borehole. The pressure drop makes it harder to force the returning fluid up to the surface. Also, the pressure drop may cause drill cuttings to drop out of the main fluid path and clog up the annulus.

Another type of gripper comprises a bladder that is inflated by fluid to bear against the borehole surface. While inflatable bladders provide good conformance to the possibly irregular dimensions of a borehole, they do not provide very good torsional resistance. In other words, bladders tend to permit a certain degree of undesirable twisting or rotation of the tractor body, which may confuse the tractor's position sensors. Additionally, some bladder configurations have durability issues as the bladder material may wear and degrade with repeated usage cycles. Also, some bladder configurations may substantially impede the flow-by of fluid and drill cuttings returning up through the annulus to the surface.

Yet another type of gripper comprises a combination of bladders and flexible beams oriented generally parallel to the tractor body on the radial exterior of the bladders. The ends of the beams are maintained at a constant radial position near the surface of the tractor body, and may be permitted to slide longitudinally. Inflation of the bladders causes the beams to flex outwardly and contact the borehole wall. This design effectively separates the loads associated with radial expansion and torque. The bladders provide the loads for radial expansion and gripping onto the borehole wall, and the beams resist twisting or rotation of the tractor body. While this design represents a significant advancement over previous designs, the bladders provide limited radial expansion loads. As a result, the design is less effective in certain environments. Also, this design impedes to some extent the flow of fluid and drill cuttings upward through the annulus.

Some types of grippers have gripping elements that are actuated or retracted by causing different surfaces of the gripper assembly to slide against each other. Moving the gripper between its actuated and retracted positions involves substantial sliding friction between these sliding surfaces. The sliding friction is proportional to the normal forces between the sliding surfaces. A major disadvantage of these grippers is that the sliding friction can significantly impede their operation, especially if the normal forces between the sliding surfaces are large. The sliding friction may limit the extent of radial displacement of the gripping elements as well as the amount of radial gripping force that is applied to the inner surface of a borehole. Thus, it may be difficult to transmit larger loads to the passage, as may be required for certain operations, such as drilling. Another disadvantage of these grippers is that drilling fluid, drill cuttings, and other particles can get caught between and damage the sliding surfaces as they slide against one another. Also, such intermediate particles can add to the sliding friction and further impede actuation and retraction of the gripper.

Yet another type of gripper comprises a pair of four-bar linkages separated by 180° about the circumference of the tractor body. FIG. 14 shows such a design. Each linkage 200 comprises a first link 201, a second link 203, and a third link 205. The first link 201 has a first end 207 pivotally or hingedly secured at or near the surface of the tractor body 209, and a second end 211 pivotally secured to a first end 213 of the second link 203. The second link 203 has a second end 215 pivotally secured to a first end 217 of the third link 205. The third link 205 has a second end 219 pivotally secured at or near the surface of the tractor body 209. The first end 207 of the first link 201 and the second end 219 of the third link 205 are maintained at a constant radial position and are longitudinally slidable with respect to one another. The second link 203 is designed to bear against the inner surface of a borehole wall. Radial displacement of the second link 203 is caused by the application of longitudinally directed fluid pressure forces onto the first end 207 of the first link 201 and/or the second end 219 of the third link 205, to force such ends toward one another. As the ends 207 and 219 move toward one another, the second link 203 moves radially outward to bear against the borehole surface and anchor the tractor.

One major disadvantage of the four-bar linkage gripper design is that it is difficult to generate significant radial expansion loads against the inner surface of the borehole until the second link 203 has been radially displaced a substantial degree. As noted above, the radial load applied to the borehole is generated by applying longitudinally directed fluid pressure forces onto the first and third links. These fluid pressure forces cause the first end 207 of the first link 201 and the second end 219 of the third link 205 to move together until the second link 203 makes contact with the borehole. Then, the fluid pressure forces are transmitted through the first and third links to the second link and onto the borehole wall. However, the radial component of the transmitted forces is proportional to the sine of the angle θ between the first or third link and the tractor body 209. In the retracted position of the gripper, all three of the links are oriented generally parallel to the tractor body 209, so that θ is zero or very small. Thus, when the gripper is in or is near the retracted position, the gripper may be incapable of transmitting significant radial load to the borehole wall. In boreholes, in which the second link 203 is displaced only slightly before coming into contact with the borehole surface, the gripper provides a very limited radial load compared to the longitudinal force exerted. Thus, in small diameter environments, the gripper may not be able to reliably anchor the tractor. The gripping ability of the four bar linkage improves significantly, however, as the angle θ reaches approximately 50° and above. As a result, this four-bar linkage gripper may not be useful in small diameter boreholes or in small diameter sections of generally larger boreholes. If the four-bar linkage was modified so that the angle θ is always large, the linkage may then be able to accommodate only very small variations in the diameter of the borehole.

SUMMARY OF THE INVENTION

As will be described in more detail below, in some embodiments, the Roller Link/Toggle ("RLT") gripper circumvents the inability of a traditional four bar linkage to apply sufficient radial force across a range of expansion diameters. Advantageously, in some embodiments, the RLT is capable of generating radial force over a wide range of expansion diameters, including relatively small expansion diameters. Some embodiments of RLT are particularly suited for use in wellbore tractors, though other uses are contemplated.

In various aspects and embodiments, an improved gripper assembly overcoming the above-mentioned problems of the prior art is provided. Embodiments of the present invention include a gripper assembly having a first actuation assembly including a roller mechanism, a second actuation assembly, a roller link having an inner surface configured to engage the roller assembly, a toe link, and a toggle link. In operation, longitudinal movement of the first and second actuation assemblies causes the toe link of the gripper assembly to deflect radially to grip onto a borehole.

In one embodiment, there is provided a gripper assembly for use with a tractor for moving within a passage. The gripper assembly is configured to be longitudinally movably engaged with an elongated shaft of the tractor. The gripper assembly has an actuated position in which it substantially prevents movement between the gripper assembly and an inner surface of the passage. The gripper assembly also has a retracted position in which it permits substantially free relative movement between the gripper assembly and the inner surface of the passage. The gripper assembly comprises an elongate body longitudinally slidable with respect to the shaft of the tractor, a first actuation assembly longitudinally slidable with respect to the elongate body and including a roller mechanism, a second actuation assembly longitudinally slidable with respect to the elongate body, a roller link having an inner surface configured to engage the roller mechanism, a toe link, and a toggle link.

Longitudinal movement of the first actuation assembly causes the roller mechanism to roll against the inner surface of the roller link causing the roller link to move away from the elongate body about a first end of the roller link. Longitudinal movement of the second actuation assembly pushes a second end of the toggle link toward the first end of the roller link. A second end portion of the roller link is pivotally connected to a first end portion of the toe link. A second end portion of the toe link is pivotally connected to a first end portion of the toggle link. When the first and second actuation assemblies move cooperatively, the resulting movement of the roller link and the toggle link cause the toe link of the gripper to be either expanded to the actuated position or contracted to the retracted position. The gripper assembly may be configured such that at small expansion diameters the roller mechanism is rotatably engaged with the inner surface of the roller link, while at larger diameters, the roller mechanism separates from the inner surface of the roller link.

In another embodiment, there is provided a gripper assembly for use with a tractor for moving within a passage. The gripper assembly is configured to be longitudinally movably engaged with an elongated shaft of the tractor. The gripper assembly has an actuated position in which it substantially prevents movement between the gripper assembly and an inner surface of the passage. The gripper assembly also has a retracted position in which it permits substantially free relative movement between the gripper assembly and the inner surface of the passage. The gripper assembly comprises an elongate body longitudinally slidable with respect to the shaft of the tractor, a first actuation assembly longitudinally slidable with respect to the elongate body and including a roller mechanism, a second actuation assembly longitudinally slidable with respect to the elongate body, a roller link having an inner surface configured to engage the roller mechanism, a toe link, and a toggle link.

Longitudinal force applied by of the first actuation assembly causes the roller mechanism to apply a force against the inner surface of the roller link causing the roller link to move away from the elongate body about a first end of the roller link. Longitudinal force applied by the second actuation assembly pushes a second end of the toggle link toward the first end of the roller link. A second end portion of the roller link is pivotally connected to a first end portion of the toe link. A second end portion of the toe link is pivotally connected to a first end portion of the toggle link. When the first and second actuation assemblies move in a same longitudinal direction, the resulting movement of the roller link and the toggle link cause the toe link of the gripper to be either expanded to the actuated position or contracted to the retracted position. The application of longitudinal forces by the first and second actuation assemblies causes the toe link to exert a radial force. The gripper assembly may be configured such that at small expansion diameters the roller mechanism is rotatably engaged with the inner surface of the roller link, while at larger diameters, the roller mechanism separates from the inner surface of the roller link.

In another embodiment, there is provided an expandable assembly for moving and anchoring a tool within a passage. The expandable assembly is a tractor for moving a tool through a passage comprising an elongate body, an expandable gripper assembly, a second gripper assembly, and at least one propulsion assembly. The expandable gripper assembly is configured to be longitudinally movably engaged with the elongate body. The expandable gripper assembly and the second gripper assembly each have an actuated position and a retracted position as described above with respect to the previously described aspect of the invention. The expandable gripper assembly comprises a first actuation assembly longitudinally slidable with respect to the elongate body and including a roller mechanism, a second actuation assembly longitudinally slidable with respect to the elongate body, a roller link having an inner surface configured to engage the roller mechanism, a toe link, and a toggle link. The second gripper assembly is configured to be selectively engaged with an inner surface of the passage. The second gripper assembly may be of the same configuration as the expandable gripper assembly, or it may be of another configuration. The propulsion assembly of the tractor is configured to advance the elongate body through the passage relative to the expandable gripper assembly and the second gripper assembly.

In another aspect, the present invention provides a gripper assembly for anchoring a tool within a passage. The gripper assembly is configured to be longitudinally movably engaged with an elongated shaft of the tool. The gripper assembly has an actuated position and a retracted position as described above. The gripper assembly comprises an elongate body longitudinally slidable with respect to the shaft of the tractor, a first actuation assembly longitudinally slidable with respect to the elongate body and including a roller mechanism, a second actuation assembly longitudinally slidable with respect to the elongate body, a first link having an inner surface configured to engage the roller mechanism, and a second link.

Longitudinal movement of the first actuation assembly causes the roller mechanism to roll against the inner surface of the first link causing the first link to move away from the elongate body about a first end of the first link. Longitudinal movement of the second actuation assembly pushes a second end of the second link toward the first end of the first link. A second end portion of the first link is pivotally connected to a first end portion of the second link. When the first and second actuation assemblies move in a same longitudinal direction, the resulting movement of the first link and the second link cause the gripper to be either expanded to the actuated position or contracted to the retracted position.

In another embodiment, there is provided a gripper assembly for anchoring a tool within a passage. The gripper assembly is configured to be longitudinally movably engaged with an elongated shaft of the tool. The gripper assembly has an actuated position and a retracted position as described above with respect to the previously described embodiment of the invention. The gripper assembly comprises an elongate body longitudinally slidable with respect to the shaft, a first actuation assembly longitudinally slidable with respect to the elongate body and including a roller mechanism, a second actuation assembly longitudinally slidable with respect to the elongate body, a roller link having an inner surface configured to engage the roller mechanism, a toe link, a toggle link, and a locking mechanism for selectively preventing the second actuation assembly from moving.

Longitudinal movement of the first actuation assembly causes the roller mechanism to roll against the inner surface of the roller link causing the roller link to move away from the elongate body about a first end of the roller link. Longitudinal movement of the second actuation assembly pushes a second end of the toggle link toward the first end of the roller link. A second end portion of the roller link is pivotally connected to a first end portion of the toe link. A second end portion of the toe link is pivotally connected to a first end portion of the toggle link. When the first and second actuation assemblies move cooperatively, the resulting movement of the roller link and the toggle link cause the toe link of the gripper to be either expanded to the actuated position or contracted to the retracted position. The locking mechanism may be engaged to prevent movement of the second actuation assembly, thereby preventing self-energizing of the gripper assembly when it is desired that the gripper assembly remain in a retracted position. The locking mechanism may comprise a ball configured to be received within a recess of the second actuation assembly.

In yet another embodiment, there is provided a tool for use in downhole operations. The tool comprises an elongate body configured for insertion into a passage, a propulsion assembly configured for producing longitudinal movement of the elongate body through the passage, and a gripper assembly coupled to the propulsion assembly. The gripper assembly is configured to be longitudinally movably engaged with an elongated shaft of the tool. The gripper assembly has an actuated position and a retracted position as described above. The gripper assembly is capable of generating at least about 300 pounds of radial force for any expansion diameter of the gripper ranging between about 2⅞ inches to about 12½ inches.

In certain embodiments, various previously known improvements on roller-to-ramp interfaces may be applied to the interface between the roller mechanism and the inner surface of the roller link in a gripper. In some embodiments, the roller links include spacer tabs that prevent the loading of the roller mechanism when the toes are relaxed (non-gripping position), thus improving the life of the roller mechanism. In some embodiments, the roller links include alignment tabs that assist in maintaining an alignment between the roller mechanism and the inner surface of the roller link, thus improving operation of the gripper assembly. In some embodiments, the inner surfaces of the roller links are configured as inclined ramps having a relatively steeper initial incline followed by a relatively shallower incline. The steeper incline allows the toes to be expanded more quickly to a position at or near a borehole surface. The shallower incline allows a desired radial gripping force to be generated and the deflection of the toe link to be more finely adjusted.

While the gripper is described herein with respect to its use in conjunction with downhole tractors, it should be recognized that the gripper of the present invention is not so limited. Rather, the gripper described herein is believed to have wide applicability in many fields. Various embodiments of the present invention relate to providing movable grippers (or anchors) to various downhole drilling, completion, and intervention tools. Embodiments of the gripper of the present invention may be used in downhole tools such as 3-D steering tools and temporary anchoring devices. Certain preferred embodiments of the present invention, described in further detail herein, are gripper devices to be used in conjunction with any type of downhole propulsion device, such as a downhole tractor. The gripper of the present invention may be used in conjunction with tractors designed to operate with wireline systems, coiled tubing systems, or rotary systems.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Coiled Tubing Tractor Systems

Figure 1:
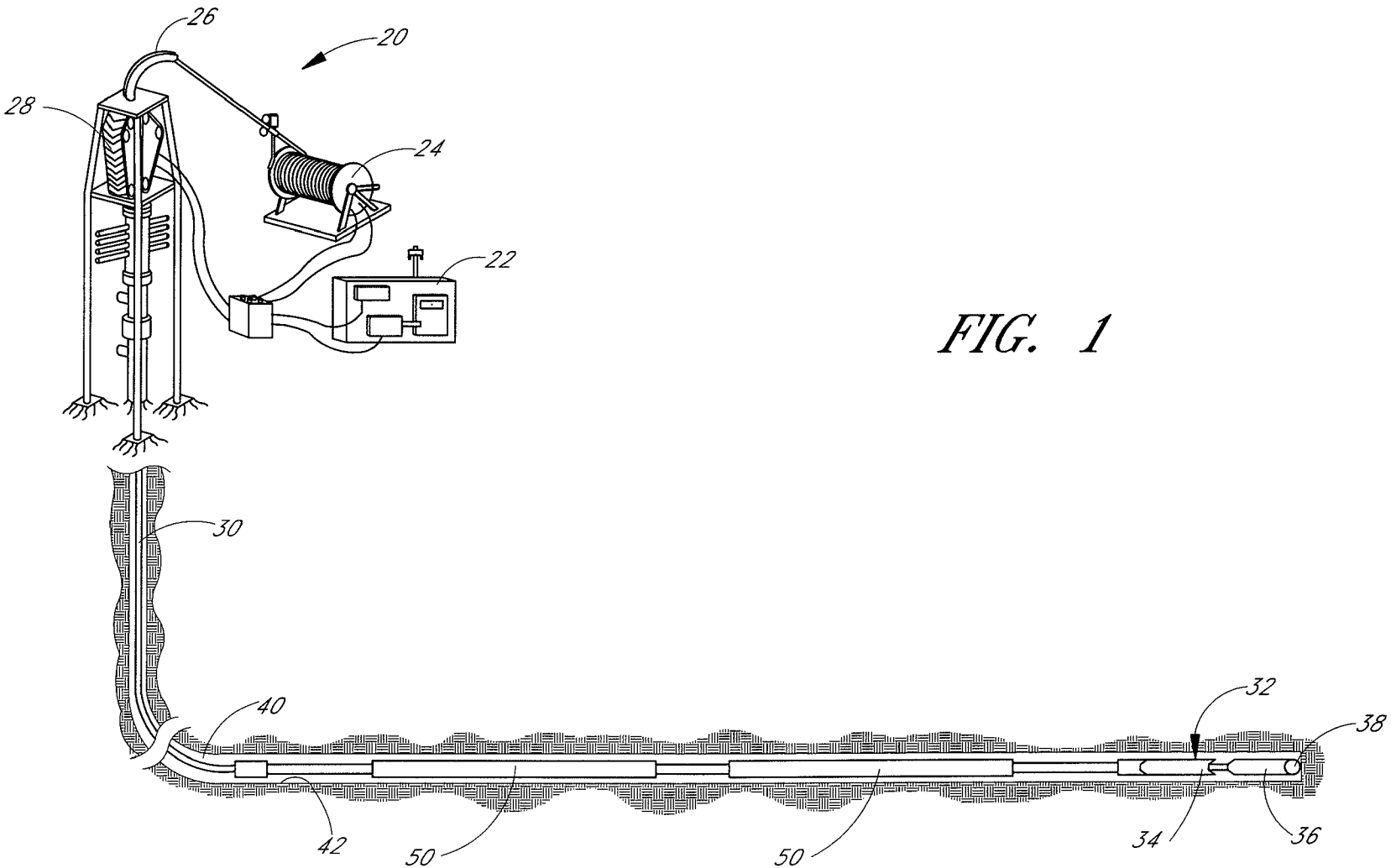
FIG. 1 is a schematic diagram of the major components of a coiled tubing drilling system having gripper assemblies according to a preferred embodiment of the present invention.
Figure 2:
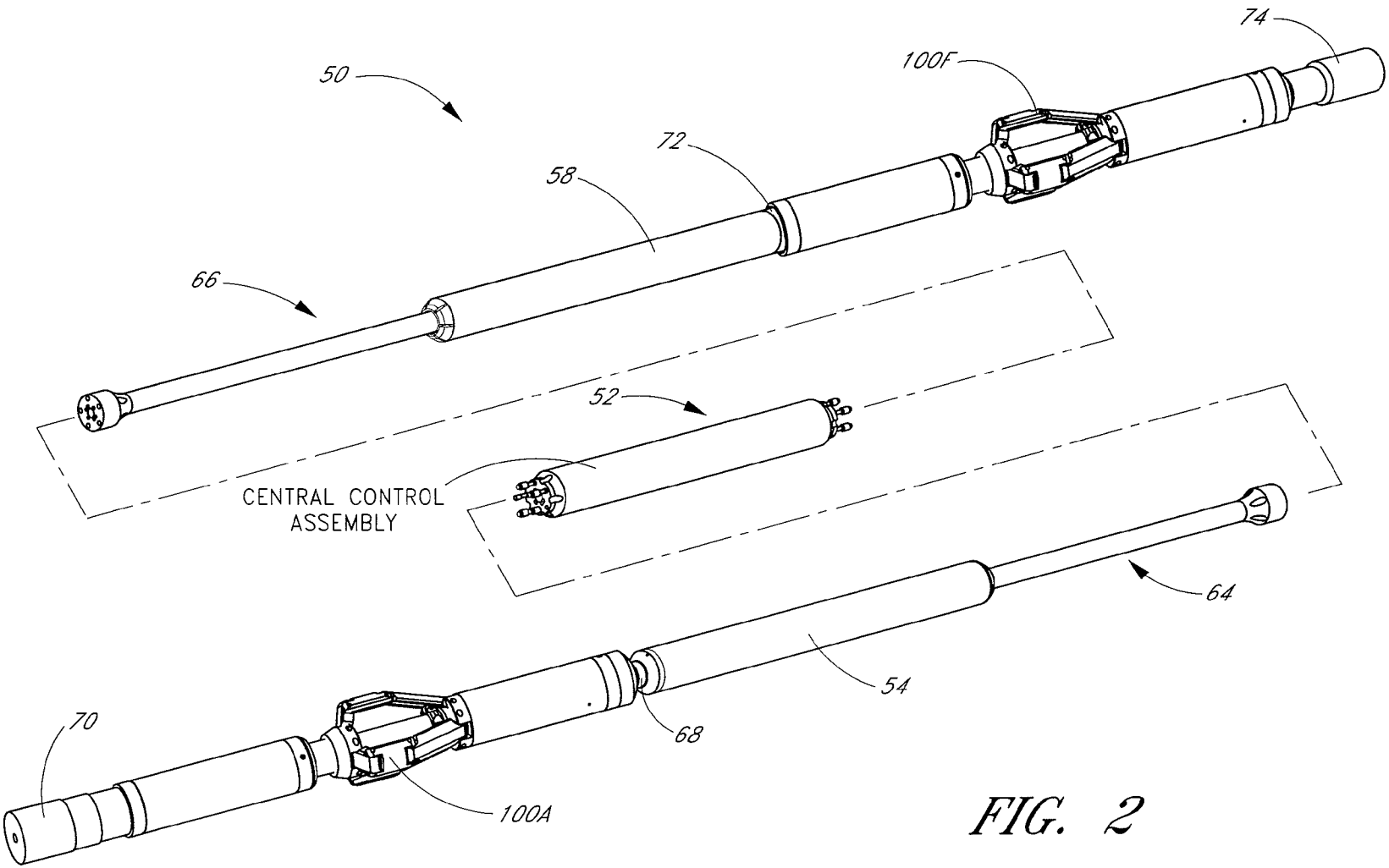
FIG. 2 is a front perspective view of a tractor having gripper assemblies according to a preferred embodiment of the present invention.

FIG. 1 shows a coiled tubing system 20 for use with two downhole tractors 50 connected by a drill string for moving within a passage. Connecting multiple tractors end-to-end may allow the use of smaller tractors, thereby facilitating maneuvering the coiled tubing system through a passage with relatively small radius turns. Although two downhole tractors 50 connected end-to-end are preferred in some applications, those of skill in the art will understand that a single tractor 50, or more than two tractors 50 could be used. Referring to FIG. 2, the illustrated tractor 50 has two gripper assemblies 100 according to the present invention. Although two gripper assemblies are preferred in some applications, those of skill in the art will understand that any number of gripper assemblies 100 may be used. In particular, one gripper assembly may be desirable, when a tractor is used in series with another tractor having two gripper assemblies. The coiled tubing drilling system 20 may include a power supply 22, tubing reel 24, tubing guide 26, tubing injector 28, and coiled tubing 30, all of which are well known in the art. The coiled tubing may be metal or composite. A bottom hole assembly 32 may be assembled with the tractor 50. The bottom hole assembly may include a measurement while drilling (MWD) system 34, downhole motor 36, drill bit 38, and various sensors, all of which are also known in the art. Alternatively, if the tractor is used for intervention, it may convey perforation guns with firing heads, production logging equipment, casing collar locators, commercial hydraulic hole cleaning tools, nozzles, hydraulic disconnects, and, if e-line is included, electrical disconnects. The tractor 50 is configured to move within a borehole having an inner surface 42. An annulus 40 is defined by the space between the tractor 50 and the inner surface 42. The tractors are shown separated by a small distance of tubing. However, the tractors may be directly connected end-to-end or separated by a long segment of coil tubing and/or other downhole tools.

Various embodiments of the gripper assemblies 100 are described herein. It should be noted that the gripper assemblies 100 may be used with a variety of different tractor designs, including, for example, (1) the "PULLER-THRUSTER DOWNHOLE TOOL," shown and described in U.S. Pat. No. 6,003,606 to Moore et al.; (2) the "ELECTRICALLY SEQUENCED TRACTOR," shown and described in U.S. Pat. No. 6,347,674 to Bloom et al.; (3) the "ELECTRO-HYDRAULICALLY CONTROLLED TRACTOR," shown and described in U.S. Pat. No. 6,241,031 to Beaufort et al.; and (4) the intervention tractor or "TRACTOR WITH IMPROVED VALVE SYSTEM" shown and described in U.S. Pat. No. 6,679,341 to Bloom et al and U.S. Patent Application Publication No. 2004/0168828, all of which are hereby incorporated herein by reference, in their entirety.

FIG. 2 illustrates one preferred embodiment of the tractor 50, shown with the aft end on the left and the forward end on the right. The illustrated tractor 50 is an Intervention Tractor (IT), as identified in U.S. Patent Application Publication No. 2004/0168828 entitled "TRACTOR WITH IMPROVED VALVE SYSTEM" listed above. The tractor 50 generally comprises a central control assembly 52, an uphole or aft gripper assembly 100A, a downhole or forward gripper assembly 100F, an aft propulsion cylinder 54, a forward propulsion cylinder 58, an aft shaft assembly 64, a forward shaft assembly 66, tool joint assemblies 70 and 74, and flex joints or adapters 68 and 72. The tool joint assembly 70 is disposed along the aft end of the aft shaft assembly 64 for connecting the drill string (e.g., coiled tubing) to the aft shaft assembly 64. The aft gripper assembly 100A, aft propulsion cylinder 54, and flex joint 68 are assembled together end-to-end and are all axially slidably engaged with the aft shaft assembly 64. Similarly, the forward gripper assembly 100F, forward propulsion cylinder 58, and flex joint 72 are assembled together end-to-end and are axially slidably engaged with the forward shaft assembly 66. The tool joint assembly 74 is preferably configured for coupling the tractor 50 to downhole equipment 32, as shown in FIG. 1. The aft shaft assembly 64, the control assembly 52 and the forward shaft assembly 66 are axially fixed with respect to one another and are generally referred to herein as the body of the tractor. Conventionally, the body of the tractor is axially fixed with respect to the downhole tubing or pipe and the downhole tools.

The gripper assemblies 100A, 100F and propulsion cylinders 54, 58 are axially slidable along the body for providing the tractor 50 with the capability of pulling and/or pushing downhole equipment 32 of various weights through the borehole (or passage). In one embodiment, the tractor 50 is capable of pulling and/or pushing a total weight of 100 lbs, in addition to the weight of the tractor itself. In various other embodiments, the tractor is capable of pulling and/or pushing a total weight of 500, 3000, and 15,000 lbs.

As used herein, "aft" refers to the uphole direction or portion of an element in a passage, and "forward" refers to the downhole direction or portion of an element. When an element is removed from a downhole passage, in most situations, the aft end of the element emerges from the hole before the forward end.

Expandable Gripper Assembly

Figure 3:
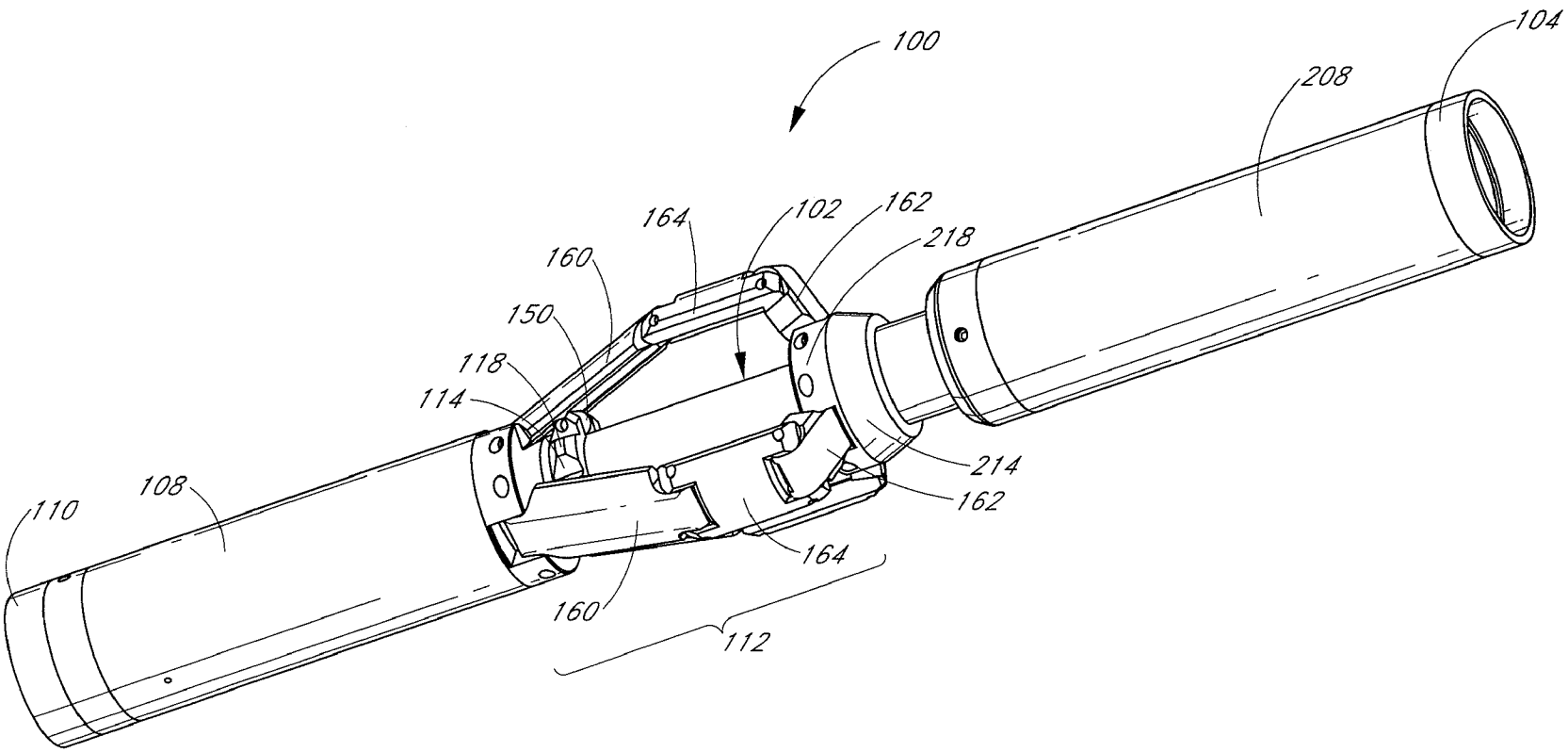
FIG. 3 is a perspective view of an expandable gripper assembly, shown in an expanded or gripping position.
Figure 6:
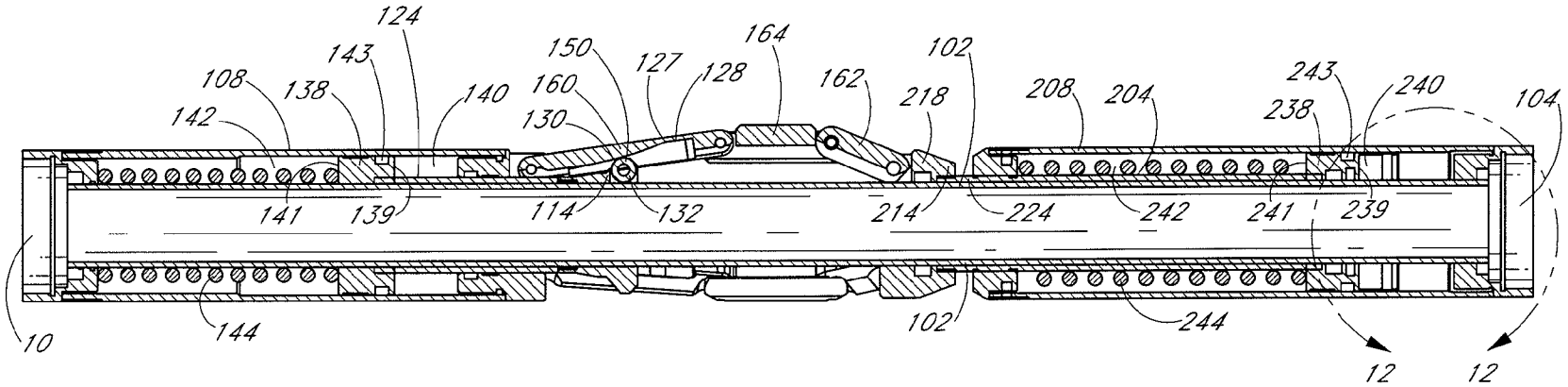
FIG. 6 is a longitudinal cross-sectional view of an expandable gripper assembly, shown in a partially-expanded position.

FIG. 3 shows a gripper assembly 100 according to one embodiment of the present invention in an expanded or gripping configuration. The illustrated gripper assembly includes an elongated body such as an elongated generally tubular mandrel 102 configured to slide longitudinally along a length of the tractor 50, such as on one of the shafts 64 and 66 (FIG. 2). Preferably, the interior surface of the mandrel 102 has a splined interface (e.g., tongue and groove configuration) with the exterior surface of the shaft, so that the mandrel 102 is free to slide longitudinally yet is prevented from rotating with respect to the shaft. In another embodiment, splines are not included. Fixed mandrel caps 110 and 104 are connected to the forward and aft ends of the mandrel 102, respectively. A first actuation assembly 118 is located on the forward end of the mandrel 102. The first actuation assembly 118 may comprise a first cylinder 108 positioned next to the mandrel cap 110 and concentrically enclosing the mandrel 102 so as to form an annular space therebetween. As shown in FIG. 6, this annular space contains a first piston 138, an aft portion of a first piston rod 124, a first spring 144, and fluid seals, for reasons that will become apparent. The first actuation assembly 118 may further comprise a first or roller sleeve 114 longitudinally slidably engaged on the mandrel 102. A roller mechanism 150 is rotatably mounted to the first actuation assembly 118. On the aft end of the mandrel 102, near the mandrel cap 104, a second actuation assembly 218 is longitudinally slidably engaged on the mandrel 102. The second actuation assembly 218 may comprise a second cylinder 208 positioned next to the mandrel cap 104 and concentrically enclosing the mandrel 102 so as to form an annular space therebetween. As shown in FIG. 6, this annular space contains a second piston 238, an aft portion of a second piston rod 224, a second spring 244, and fluid seals. The second actuation assembly 218 may further comprise a second or toggle sleeve 214 longitudinally slidably engaged on the mandrel 102. In one configuration, the roller sleeve 114 and the toggle sleeve 214 are each prevented from rotating with respect to the mandrel 102, such as by a splined interaction therebetween.

The first and second cylinders 108, 208 are fixed with respect to the mandrel 102. A plurality of grippers 112 are secured onto the expandable gripper assembly 100. The grippers 112 comprise: a first link 160 having a first end pivotally connected to the mandrel 102 and connected to a second link 162; the second link 162 having a second end connected to the mandrel 102. The grippers 112 include a gripping surface to apply a radial force to an inner wall of a passage. In the illustrated embodiment, the gripper surface is defined by a third link 164 disposed between said first and second links 160, 162 such that a first end of the third link 164 is pivotally coupled to a second end of the first link 160 and a second end of the third link 164 is pivotally coupled to a first end of the second link 162. The first end of the first link 160 is pivotally or hingedly secured to the mandrel 102, and a second end of the third link 164 is pivotally or hingedly secured to the toggle sleeve 214. As depicted in FIG. 3, the first link 160 may be longer than the second link 162. As used herein, "pivotally" or "hingedly" describes a connection that permits rotation, such as by an axle, pin, or hinge. In various embodiments of the present invention, the first link 160 of the expandable gripper assembly is interchangeably referred to as the roller link 160, the second link 162 is interchangeably referred to as the toggle link 162, and the third link 164 is interchangeably referred to as the toe link 164.

Those of skill in the art will understand that any number of grippers 112 may be provided for each expandable gripper assembly 100. As more grippers 112 are provided, the maximum radial load that can be transmitted to the borehole surface is increased. This improves the gripping power of the expandable gripper assembly 100, and therefore permits greater radial thrust and drilling power of the tractor. If the required tool diameter is small, then one or two grippers 112 may be used on each expandable gripper assembly 100. However, it is preferred to have three grippers 112 for each gripper assembly 100 for more reliable gripping of the expandable gripper assembly 100 onto the inner surface of a borehole, such as the surface 42 in FIG. 1. For example, an embodiment with four grippers could result in only two of the grippers making contact with the borehole surface in oval-shaped holes. Additionally, as the number of grippers increases, so does the potential for synchronization and alignment problems among the grippers. In addition, at least three grippers are preferred, to substantially prevent the potential for rotation of the tractor about a transverse axis, i.e., one that is generally perpendicular to the longitudinal axis of the tractor body. For example, the prior art four-bar linkage gripper described above has only two linkages. Even when both linkages are actuated, the tractor body can rotate about the axis defined by the two contact points of the linkages with the borehole surface. A three-gripper embodiment of the present invention substantially prevents such rotation. The three gripper configuration also assures that the hole will be gripped and the tractor located in the center of the hole, thus improving the overall conveyance of the payload. Further, expandable gripper assemblies 100 having at least three grippers 112 are more capable of traversing underground voids in a borehole.

Figure 3A:
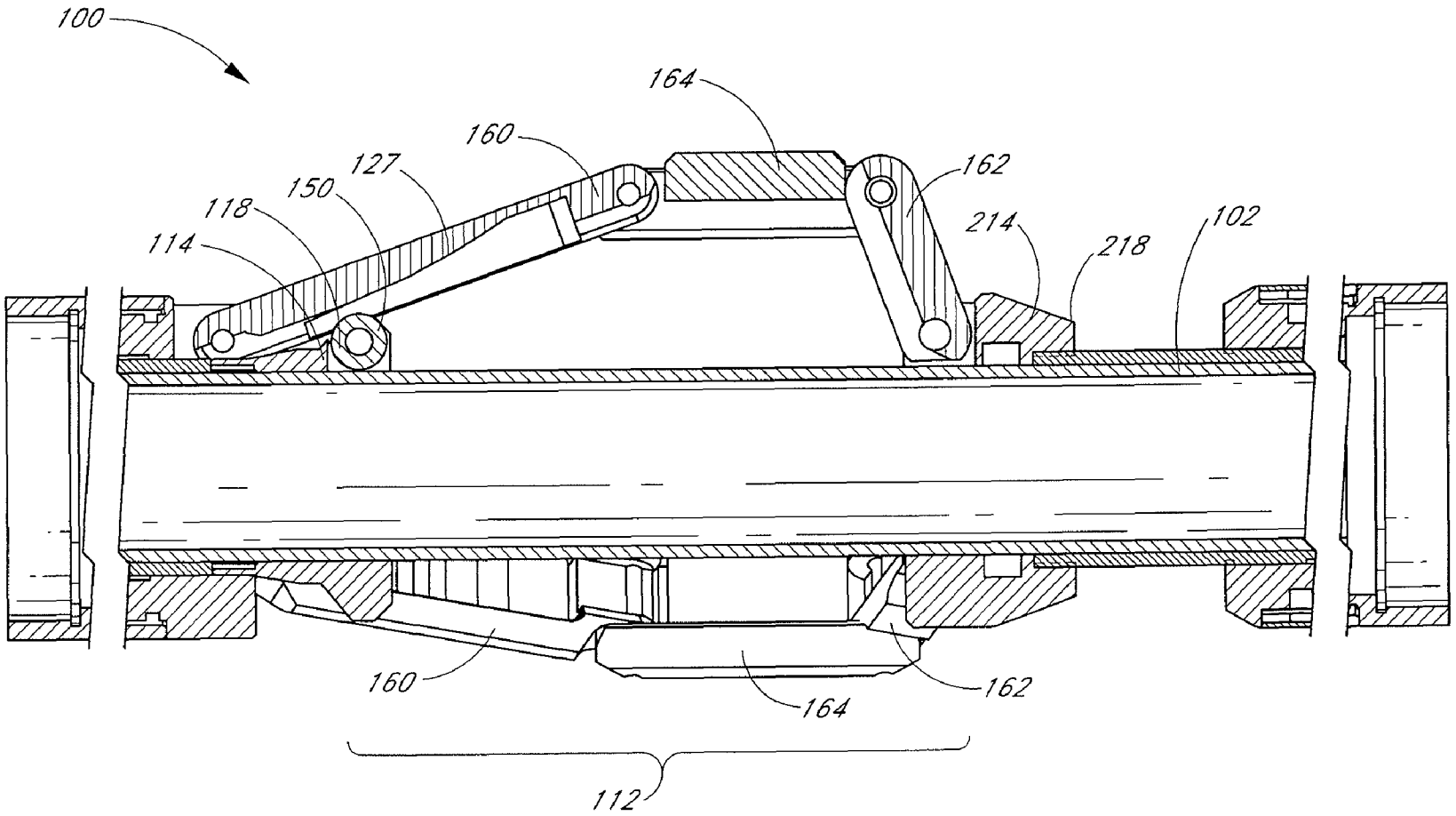
FIG. 3A is a cross-sectional side view of an expandable gripper assembly, shown in an expanded position.
Figure 4:
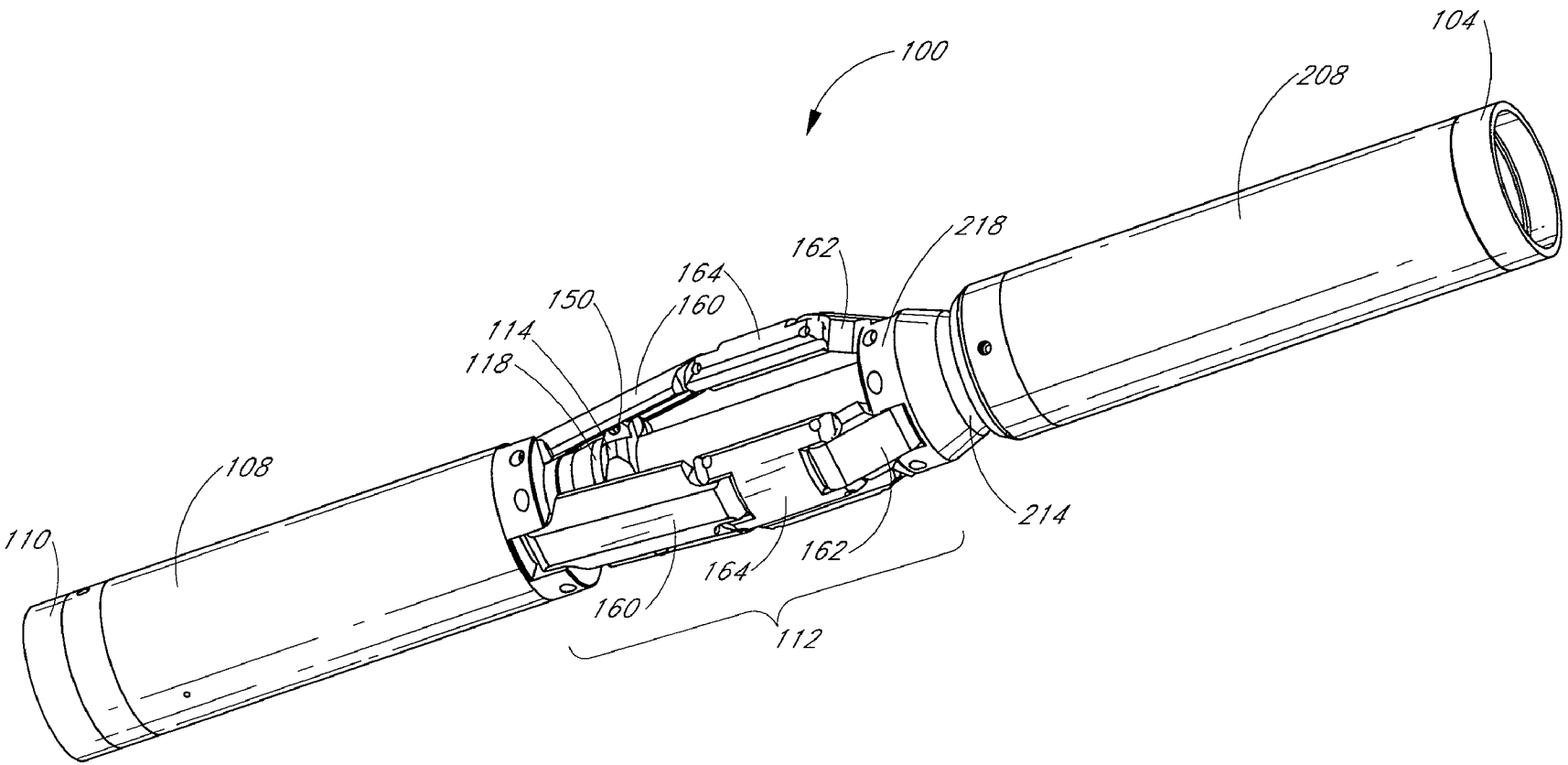
FIG. 4 is a perspective view of an expandable gripper assembly, shown in a partially expanded position.
Figure 4A:
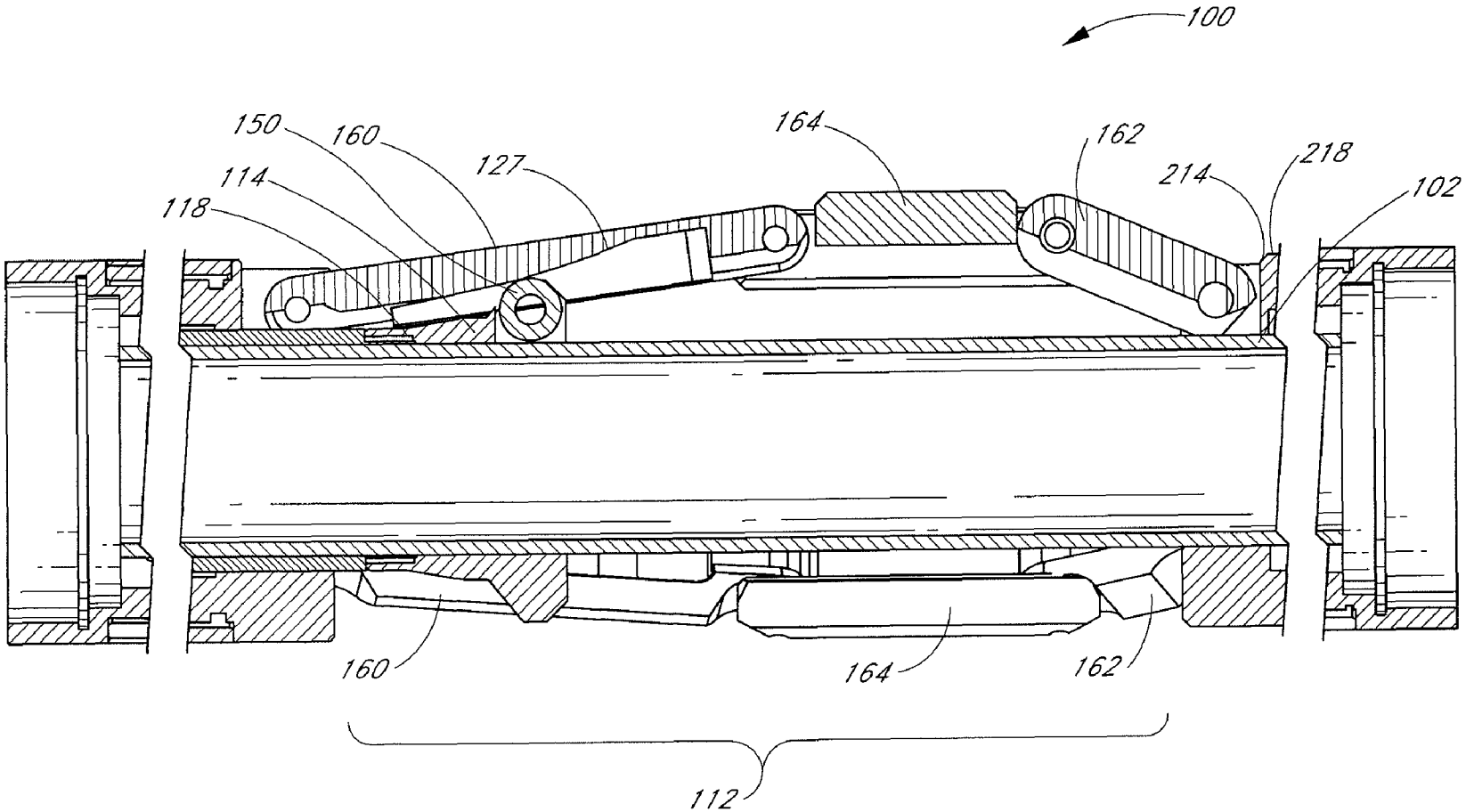
FIG. 4A is a cross-sectional side view of an expandable gripper assembly, shown in a partially expanded position.
Figure 5:
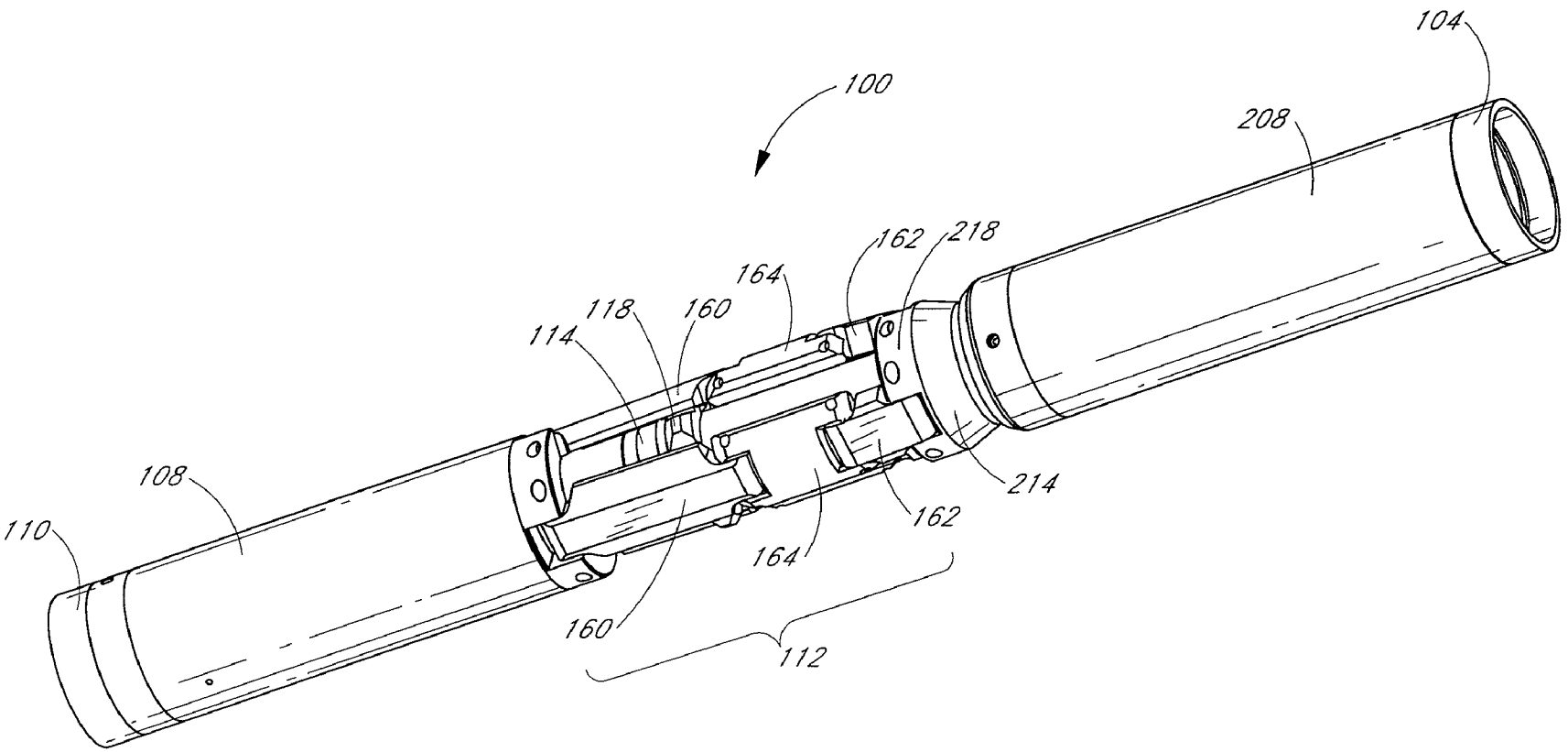
FIG. 5 is a perspective view of an expandable gripper assembly, shown in a retracted or non-gripping position.
Figure 5A:
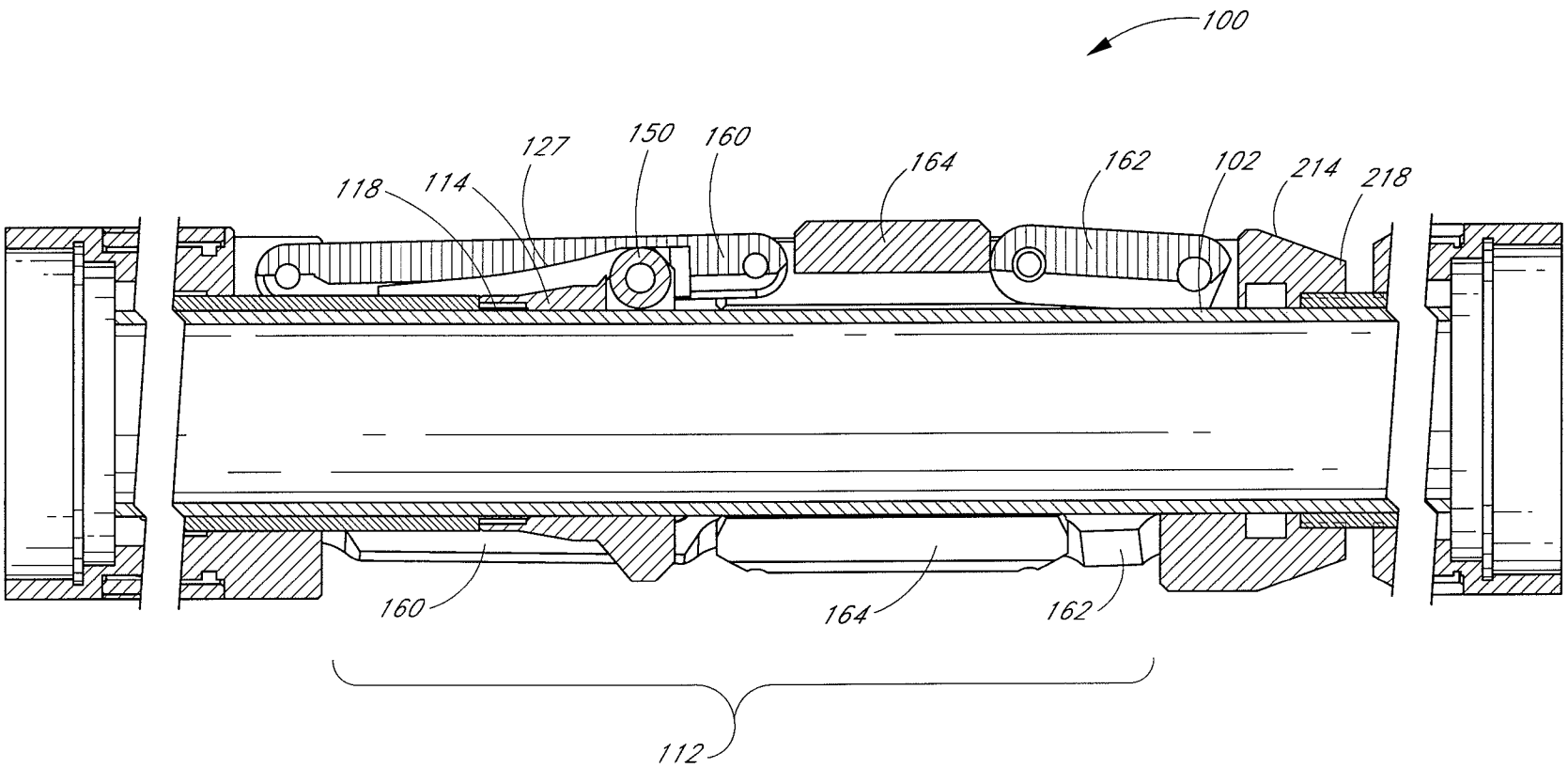
FIG. 5A is a cross-sectional side view of an expandable gripper assembly, shown in a retracted or non-gripping position.

FIG. 3A shows a longitudinal cross-section of a gripper assembly 100 in an expanded or gripping configuration. FIGS. 4 and 4A depict an expandable gripper assembly of the present invention in a partially expanded position. FIGS. 5 and 5A depict an expandable gripper assembly of the present invention in a retracted or non-gripping position. When viewed in order from FIGS. 3 through 5, the figures depict a retracting sequence of the expandable gripper assembly of the present invention. When viewed in reverse order from FIGS. 5 through 3, the figures depict an expansion sequence of the gripper assembly of the present invention. As seen in the figures, during an expansion sequence, longitudinal movement of the first actuation assembly 118 causes the roller mechanism 150 to push on the inner surface 127 of the roller link 160, thereby causing the roller link 160 to pivot away from the mandrel 102 about the first end of the roller link 160. Movement of the second actuation assembly 218 pushes the second end of the toggle link 162 toward the first end of the roller link 160. As depicted, movement of the first actuation assembly 118 and the second actuation assembly 218 in a same longitudinal direction effect radial movement of the toe link 164. Alternately, the first actuation assembly 118 and the second actuation assembly 218 may be configured to move in a different longitudinal direction in order to effect radial movement of the toe link 164. Thus, the first actuation assembly 118 and the second actuation assembly 218 may be configured to cooperate to effect radial expansion or radial contraction of the third link 164.

The toe link 164 of the expandable gripper assembly has an outer surface that is preferably roughened to permit more effective gripping against a surface, such as the inner surface of a borehole or passage. In various embodiments, the grippers 112 have a bending strength within the range of 50,000-350,000 psi, within the range of 60,000-350,000 psi, or within the range of 60,000-150,000 psi. In various embodiments, the grippers 112 have a tensile modulus within the range of 1,000,000-31,000,000, within the range of 1,000,000-15,000, 000 psi, within the range of 8,000,000-30,000,000 psi, or within the range of 8,000,000-15,000,000 psi. In the illustrated embodiment, the grippers are preferably comprised of a copper-beryllium alloy with a tensile strength of 150,000 psi and a tensile modulus of 10,000,000 psi.

When the expandable gripper assembly performs an expansion sequence as depicted in FIGS. 3, 4, and 5, the first actuation assembly 118 applies a longitudinal force to the roller mechanism 150 such that it rotatably engages an inner surface 127 of the roller link 160. The inner surface 127 of the roller link 160 may be an inclined ramp 126 having a radially inner end and a radially outer end. As the roller mechanism 150 rotatably engages the inclined ramp, it applies a force to the inner surface 127 of the roller link 160. As the first actuation assembly 118 rolls the roller mechanism 150 along the inclined ramp 126 from the radially inner end to the radially outer end, the force applied by the roller mechanism 150 causes the toe link 164 to expand radially outward. During an expansion sequence, the second actuation assembly 218 applies a longitudinal force to longitudinally slide a second end of the toggle link 162 towards the first end of the roller link 160. This application of longitudinal force to the toggle link 162 causes the toggle link 162 to pivot away from the mandrel 102 about the second end of the toggle link 162.

During an expansion sequence, the movement of the first and second actuation assemblies 118, 218 may be coordinated to radially expand the toe link 164 such that for small radial expansions, the force applied to, and movement of the toe link 164 is predominantly effected by the movement of the roller mechanism 150. At a larger radial expansion during the expansion sequence, however, the roller mechanism 150 reaches the radially outer end of the inclined ramp, and the roller mechanism 150 separates from the inclined ramp (as depicted in FIGS. 3 and 3A). For these larger radial expansions, the radial movement of, and radial force applied by the toe link 164 is primarily effected by the movement of the second actuation assembly 218 and the longitudinal force exerted by the second actuation assembly 218.

In one embodiment, the movement of the first and second actuation assemblies 118 may be coordinated to radially expand the toe link 164 such that for a range of angles formed between a longitudinal axis of the roller link 160 and a longitudinal axis of the elongate body 102 between 0° and 45°, or, in an alternate configuration, between 0° and 28°, the force applied to, and movement of the toe link 164 is primarily effected by the movement of the roller mechanism 150 and the application of force by the roller mechanism 150 on the inner surface 127 of the roller link 160. The first and second actuation assemblies 118, 218 could further be coordinated such that for a range of angles formed between a longitudinal axis of the toggle link 162 and the elongate body 102 between 40° and 80°, or, in an alternate configuration, between 28° and 80°, the force applied to, and movement of the toe link 164 is primarily effected by the movement of the second actuation assembly 218 and the longitudinal force exerted by the second actuation assembly 218 on the second end of the toggle link 162.

Since the force applied by the roller mechanism 150 directly to an inner surface 127 of the roller link 160 dominates at small radial expansions of the toe link 164, the expandable gripper assembly of the present invention is capable of exerting a large radial force even at small radial expansions. Furthermore, gripper assemblies of the present invention may be configured to expand to larger radial expansions than were available with various grippers of the prior art. Therefore, the gripper assembly of the present invention is capable of applying a large radial force over any radial expansion from a small radial expansion to a large radial expansion. In one embodiment of the present invention, the expandable gripper assembly is capable of generating a radial force of at least about 300 pounds and, preferably, at least about 1000 pounds for any radial expansion of the toe link 164 of the gripper assembly that would apply the radial force to an inner wall of a substantially cylindrical passage having an inner diameter of any diameter in a range from about 3½ inches to about 8½ inches. In another embodiment, the expandable gripper assembly is capable of generating a radial force of at least about 300 pounds and, preferably, at least 1000 pounds for any radial expansion of the toe link 164 of the gripper assembly that would apply the radial force to an inner wall of a substantially cylindrical passage having an inner diameter of any diameter in a range from about 2⅞ inches to about 12½ inches.

Figure 7:
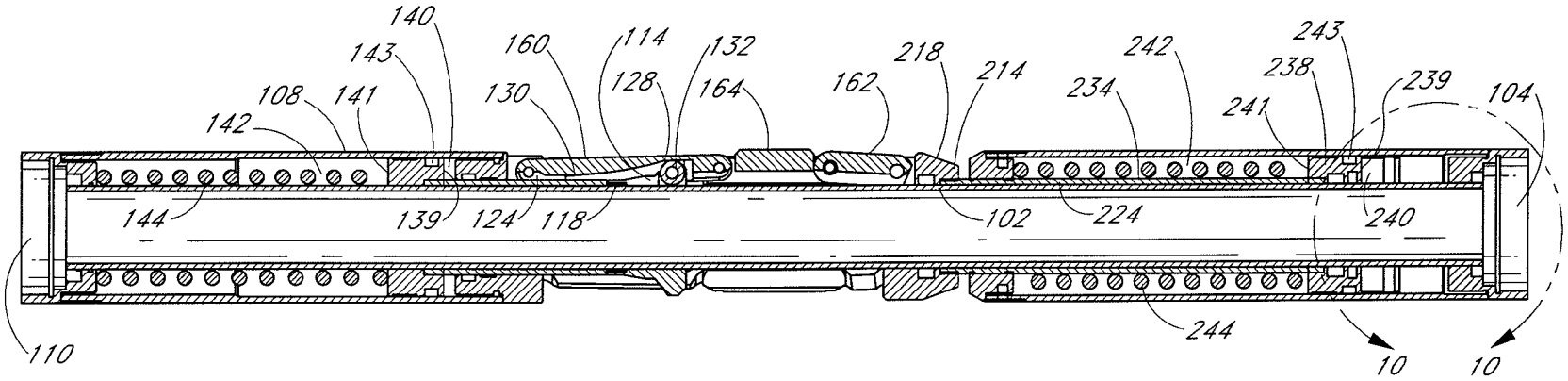
FIG. 7 is a longitudinal cross-sectional view of an expandable gripper assembly, shown in a closed position.

FIGS. 6 and 7 show a longitudinal cross-section of an expandable gripper assembly 100 in partially-expanded and closed positions respectively. As seen in the figures, the inner surface 127 of the roller link 160 includes an inclined ramp 126. The ramp 126 slopes between an inner radial level 128 and an outer radial level 130, the inner level 128 being radially further from the surface of the mandrel 102 than the outer level 130. Thus, when the roller mechanism 150 is engaged with the inner surface 127 of the roller link 160 at the inner radial level 128, the gripper assembly is in a retracted or non-gripping position, and when the roller mechanism 150 rolls towards the outer radial level 130, the roller link 160 pivots away from the mandrel 102 about a first end of the roller link 160. Preferably, the inner surface 127 of the roller link 160 includes one ramp 126 for each gripper 112, as depicted in FIGS. 6-7. Of course, the inner surface 127 of the roller link 160 may include any number of ramps 126 for each gripper 112. As more ramps 126 are provided for each roller link 160, the amount of force that each ramp must transmit is reduced, producing a longer fatigue life of the ramps and the roller links 160. Also, the provision of additional ramps results in more uniform radial displacement of the toe links 164, resulting in better overall gripping onto the borehole surface.

In the embodiment illustrated in FIGS. 3-7, the roller mechanism 150 comprises one or more rollers 132 that are rotatably secured on the roller sleeve 114 and configured to roll upon the inclined surfaces of the ramps 126. Preferably, there is one roller 132 for every ramp 126 on the inner surface 127 of the roller link 160. In the illustrated embodiments, the roller 132 of each gripper 112 is rotatably mounted to a radially exterior surface of the roller sleeve 114. The roller 132 may rotate on a roller axle that extends transversely with respect to the mandrel. The ends of the roller axle are secured within holes in radially exterior sidewalls of the roller sleeve 114.

FIGS. 6 and 7 also illustrate the operation of the first and second actuation assemblies 118, 218 according to an embodiment of an expandable gripper assembly of the present invention. The first and second piston rods 124, 224 connect the roller sleeve 114 and the toggle sleeve 214 respectively to the corresponding piston 138, 238 enclosed within the corresponding cylinder 108, 208. The first and second pistons 138, 238 desirably have a generally tubular shape. The pistons 138, 238 each have an aft or actuation side 139, 239 and a forward or retraction side 141, 241. The first and second piston rods 124, 224 and the first and second pistons 138, 238 are longitudinally slidably engaged on the mandrel 102. The aft end of the first piston rod 124 is attached to the roller sleeve 114. The forward end of the first piston rod 124 is attached to the actuation side 139 of the first piston 138. The forward end of the second piston rod 224 is attached to the toggle sleeve 214. The aft end of the second piston rod 224 is attached to the retraction side 241 of the second piston 238. Each piston 138, 238 fluidly divides the annular space between the mandrel 102 and the corresponding cylinder 108, 208 into an actuation chamber 140, 240 and a retraction chamber 142, 242. A seal such as a rubber O-ring is preferably provided in a groove 143, 243 between the outer surface of each piston 138, 238 and the inner surface of the corresponding cylinder 108, 208. A return spring 144, 244 is engaged on each piston rod 124, 224 and enclosed within the corresponding cylinder 108, 208. The return springs 144, 244 each have an end attached to and/or biased against the retraction side 141, 241 of the corresponding piston 138, 238. An opposite end of each of the springs 144, 244 is attached to and/or biased against the interior surface of an end of the corresponding cylinder 108, 208. The springs 144, 244 each bias the corresponding piston 138, 238, piston rod 124, 224, and corresponding sleeve 114, 214 toward the aft end of the mandrel 102. In the illustrated embodiment, the springs 144, 244 comprise coil springs. The number of coils and spring diameter is preferably chosen based on the required return loads and the space available. Further, the return spring 144 chosen for the first actuation assembly 118 may be of a different configuration of number of coils and spring diameter than the return spring 244 chosen for the second actuation assembly 218. Those of ordinary skill in the art will understand that other types of springs or biasing means may be used. While the first and second actuation assemblies are illustrated herein as hydraulic piston, cylinder, return spring assemblies, it is recognized that various other actuation assemblies known in the art may alternatively be used with an expandable gripper of the present invention. For example, the first and second actuation assemblies may comprise double acting pistons with no return springs or electric motors.

The expandable gripper assembly 100 has an actuated position (as shown in FIG. 3) in which it substantially prevents movement between itself and an inner surface of the passage or borehole. The expandable gripper assembly 100 has a retracted position (as shown in FIG. 5) in which it permits substantially free relative movement between itself and the inner surface of the passage. In the retracted position of the gripper assembly 100, the toe link 164 is retracted. In the expanded position, the toe link 164 is expanded radially outward so that the exterior surface of the toe link 164 comes into contact with the inner surface 42 (FIG. 1) of a borehole or passage. In the actuated position, the toggle sleeve 214 is longitudinally displaced towards a first end of the roller link 160 and the roller 132 has become separated from the ramp. In the retracted position, toggle sleeve 214 is not displaced towards a first end of the roller link 160 and the roller 132 is at a radial inner level 128 of the ramps 126.

The positioning of the first and second pistons 138, 238 controls the position of the gripper assembly 100 (i.e., actuated or retracted). Preferably, the positions of the pistons 138, 238 are controlled by supplying pressurized fluid to the respective actuation chambers 140, 240. The fluid exerts a pressure force onto the actuation sides 139, 239 of the corresponding piston 138, 238, which tends to move each of the pistons 138, 238 toward the forward end of the mandrel 102. The force of the springs 144, 244 acting on the retraction sides 141, 241 of the corresponding piston 138, 238 opposes this pressure force. It should be noted that the opposing spring force increases as the pistons 138, 238 each move to compress the spring 144, 244. Thus, the pressure of fluid in the first and second actuation chambers 140, 240 controls the position of each piston 138, 238. The piston diameters are sized to receive force to move the corresponding sleeves 114, 214 and piston rods 124, 224. The surface area of contact of each piston 138, 238 and the fluid is preferably within the range of 1.0-10.0 $in^2$. Depending on the required load, the first piston may be sized differently from the second piston.

Forward motion of the first piston 138 causes the first piston rod 124 and the roller sleeve 114 to move forward as well. As the roller sleeve 114 moves forward to an actuation position, the roller mechanism 150 moves forward, causing the roller 132 to roll up the inclined surface of the ramp on the inner surface 127 of the roller link 160. Forward motion of the second piston 238 causes the second piston rod 224 and the toggle sleeve 214 to move forward as well. As the toggle sleeve 214 moves forward, it causes the toggle link 162 to pivot away from the mandrel about its second end. Thus, the forward motion of the roller sleeve 114 and the toggle sleeve 214 outwardly radially displaces the toe link 164. In such a manner, the longitudinal force applied to the roller sleeve 114 and toggle sleeve 214 by the corresponding piston is transferred into a radial force generated by the toe link 164.

Thus, the gripper assembly 100 is actuated by increasing the pressure in the first and second actuation chambers 140, 240 to a level such that the pressure force on the actuation sides 139, 239 of the corresponding pistons 138, 238 overcome the force of the return springs 144, 244 acting on the retraction sides 141, 241 of the corresponding pistons 138, 238. The gripper assembly 100 is retracted by decreasing the pressure in the actuation chambers 140, 240 to a level such that the pressure force on the corresponding piston 138, 238 is overcome by the force of the corresponding spring 144, 244. The spring 144, 244 then forces the corresponding piston 138, 238 and thus the corresponding sleeve 114, 214, in the aft direction. In the case of the roller sleeve 114, this spring force allows the roller 132 to roll down the ramp 126 so that the roller link 160 pivots about its first end towards the mandrel. In the case of the toggle sleeve 214, this spring force allows the toggle link 162 to pivot about its second end towards the mandrel 102. When the roller sleeve 114 and toggle sleeve 214 have slid back to a retracted position, the grippers 112 are completely retracted and generally parallel to the mandrel 102.

The actuation and retraction of the first and second pistons 138, 238 may be coordinated to effect a smooth radial expansion and retraction of the toe link 164 of the gripper assembly. One embodiment of the present invention relies on expansion of the toe link 164 (see FIG. 3) using the roller mechanism 150 as actuated by the first actuation assembly 118 primarily to effect smaller radial expansions and using the longitudinal movement of the toggle mechanism primarily to effect the larger diameter expansions. From the retracted position (FIG. 5), as the expandable gripper assembly 100 actuation initiates, the roller link 160, driven by the roller mechanism 150 rotatably engaged to an inclined ramp of its inner surface 127, and the toggle link 162, pivoted outward about its second end by longitudinal movement of the toggle sleeve 214 begin to drive the toe link 164 radially outward. When the toe link 164 reaches a smaller diameter well bore, the roller link 160 will generate the majority of the radial load using the inner surface 127 of the roller link 160 on which the roller mechanism 150 is engaged. The toggle link 162 will desirably will generate additional load at smaller radial expansions. But, when the gripper encounters larger diameter well bores, the toggle link 162 will predominately generate the radial load (FIG. 3). At radial expansions of the gripper assembly 100 corresponding to larger diameter wellbores, the roller link 160 has departed from the inner surface 127 of the roller link 160.

In operation, the gripper assembly 100 slides along the body of the tractor 50 (FIG. 2), so that the tractor body can move longitudinally when the gripper assembly grips onto the inner surface of a borehole. In particular, the mandrel 102 slides along a shaft of the tractor body, such as the shafts 64 or 66 of FIG. 2. These shafts preferably contain fluid conduits for supplying drilling fluid to the various components of the tractor, such as the propulsion cylinders and the gripper assemblies. Preferably, the mandrel 102 contains an opening so that fluid in one or more of the fluid conduits in the shafts can flow into the actuation chambers 140, 240. Valves within the remainder of the tractor preferably control the fluid pressure in the actuation chambers 140, 240.

Various aspects of roller-ramp interfaces known in the prior art may be applied to an expandable gripper of the present invention. For example, the roller mechanism may include a pressure compensated lubrication system, alignment tabs, and spacing tabs to ensure their durability and reliability. The roller sleeve 114 houses the rollers 132 and may house a pressure compensated lubrication system for the rollers. The lubrication system may comprise two elongated lubrication reservoirs (one in each sidewall), each housing a pressure compensation piston. The reservoirs preferably contain a lubricant, such as oil or hydraulic fluid, which surrounds the ends of the roller axles. Each side wall may include one reservoir that lubricates the ends of the axle for the roller 132 rotatably mounted to the roller sleeve 114. Preferably, seals, such as O-ring or Teflon lip seals, are provided between the ends of the rollers 132 and the interior of the side walls to prevent "flow-by" fluid in the recess from contacting the axles. As noted above, the axles can be maintained in recesses in the inner surfaces of the sidewalls. Alternatively, the axles can be maintained in holes that extend through the sidewalls, wherein the holes are sealed on the outer surfaces of the sidewalls by plugs.

The expandable gripper assemblies may also include spacer tabs as are known in the art to prevent the roller 132 from contacting the inner surface 127 of the roller link 160 when the expandable gripper assembly is in a retracted position. The spacer tabs absorb radial loads between the roller 132 and the inner surface 127 of the roller link 160. Advantageously, the roller 132 does not bear the load when the expandable gripper assembly is contracted, thus increasing the life of the roller axles. When the expandable gripper assemblies are contracted, the spacer tabs bear directly against the inner surface 127 of the roller link 160. The spacer tabs are sized so that when the toes expandable gripper assembly is retracted, the roller 132 does not contact the ramp 126. Those of ordinary skill in the art will understand that the function achieved by the spacer tabs can also be achieved by other configurations. For example, the inner surface 127 of the roller link 160 can be configured to bear against an upper surface of the roller sleeve 114 when the expandable gripper assembly is in the retracted position.

The expandable gripper assemblies preferably include alignment tabs as are known in the art. When the grippers 112 are radially expanded or contracted, the alignment tabs maintain the alignment between the roller 132 and the ramp 126 and prevent the rollers from sliding off of the sides of the ramps. Misalignment between the roller and the ramp can cause accelerated wear and, in the extreme, can render the expandable gripper assembly 100 inoperable. In the preferred embodiment, a pair of alignment tabs is provided for each ramp 126, one on each side of the ramp. Each pair of tabs straddles the ramp 126 to prevent the roller 132 from sliding off it.

The piston-cylinder-return spring assemblies of the first and second actuation assemblies 118, 218 have seen substantial experimental verification of operation and fatigue life. In particular, the cylinder-piston-return spring have been constructed and demonstrated to operate up to 2000 psi on water, brine, and diesel oil.

Method of the Present Invention

Another embodiment of the present invention is a method of griping a surrounding surface with an expandable assembly for use with a tractor for moving within a passage. An expandable assembly such as is described above may be used in the method of the present invention. The method comprises the steps of: longitudinally moving a first actuation assembly of the expandable assembly to cause the roller mechanism to push on the inner surface of the roller link, thereby causing the roller link to pivot away from the elongate body and causing the toe link to move radially outward; and longitudinally moving a second actuation assembly of the expandable assembly in a same direction as said first actuation assembly to push said second end of said toggle link toward said first end of said roller link thereby causing the toe link to move radially outward. The method may further comprise the step of separating the roller mechanism from the inner surface of the roller link at a large radial expansion of the toe link to allow for large expansions of the expandable assembly. The method may also comprise the step of coordinating the movements of the first and second actuation assemblies to cause the toe link of the expandable assembly to expand.

Radial Loads Transmitted to Borehole

The gripper assembly 100 described above and shown in FIGS. 3-7 provides significant advantages over the prior art. In particular, the gripper assembly 100 can transmit significant radial loads onto the inner surface of a borehole to anchor itself, even when the toe link 164 is only slightly radially displaced. Further, these significant radial loads can be maintained by the gripper for any radial expansion amount across a broad expansion range. The radial load applied to the borehole is generated by applying longitudinally directed fluid pressure forces onto the actuation sides 139, 239 of the corresponding piston 138, 238. These fluid pressure forces cause the roller sleeve and the toggle sleeve 114, 214 to move forward, which causes the roller 132 to roll against the ramp 126 and the toggle link 162 to pivot away from the mandrel 102 until the toe link 164 is radially displaced and comes into contact with the surface 42 of the borehole. At smaller radial expansions of the gripper assembly, the fluid pressure forces are primarily transmitted through the roller 132 and the ramp 126 to the toe link 164. In one embodiment, for a range of angles formed between the roller link 160 and the mandrel 102, the radial force transmitted to the toe link 164 is primarily generated by the fluid pressure force of the first actuation assembly 118. Advantageously, the amount of radial force that can be generated at the toe link 164 is not limited in smaller radial expansions by the sine of an angle formed between the roller link 160 and the mandrel. Rather, the roller 132 to ramp 126 interface allows a more direct transmission of the longitudinal pressure force of the first actuation assembly 118 to a radial force applied at the toe link 164. At larger radial expansions (or in one embodiment, at a range of angles formed between the toggle link 162 and the mandrel 102) of the expandable gripper assembly, the roller 132 separates from the ramp 126, and the fluid pressure forces of the second piston 238 on the toggle sleeve 214 primarily contributes to the radial force applied at the toe link 164.

Figure 8:
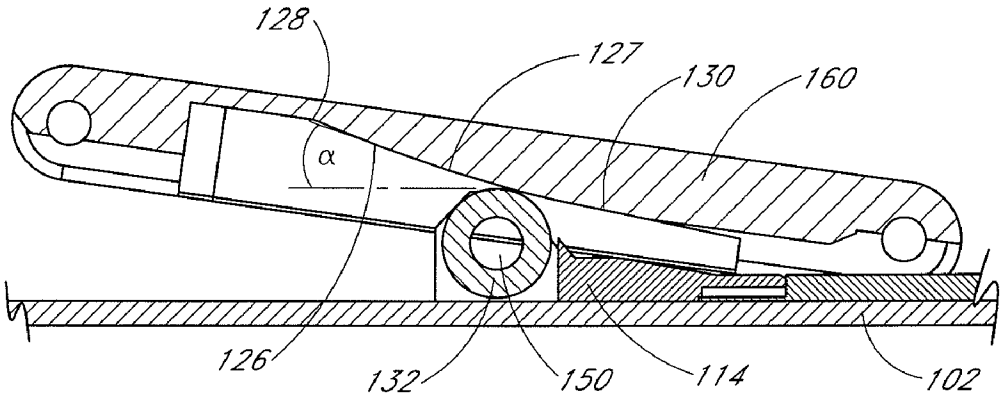
FIG. 8 is a side view of the roller and an inner surface of the roller link of the expandable gripper assembly of FIGS. 3-7, the inclined surfaces of the ramps having a generally convex shape with respect to the roller link.
Figure 9:
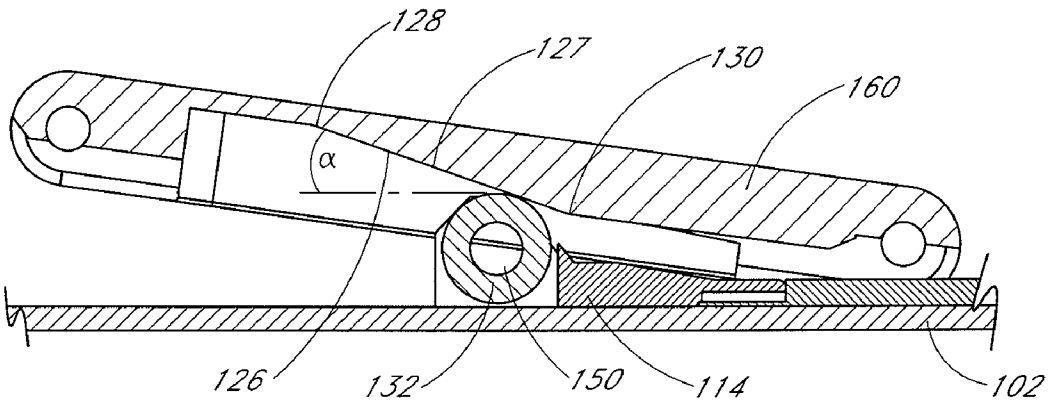
FIG. 9 is a side view of the roller and an inner surface of the roller link of the expandable gripper assembly of FIGS. 3-7, the inclined surfaces of the ramps having a generally straight shape with respect to the roller link.
Figure 10:
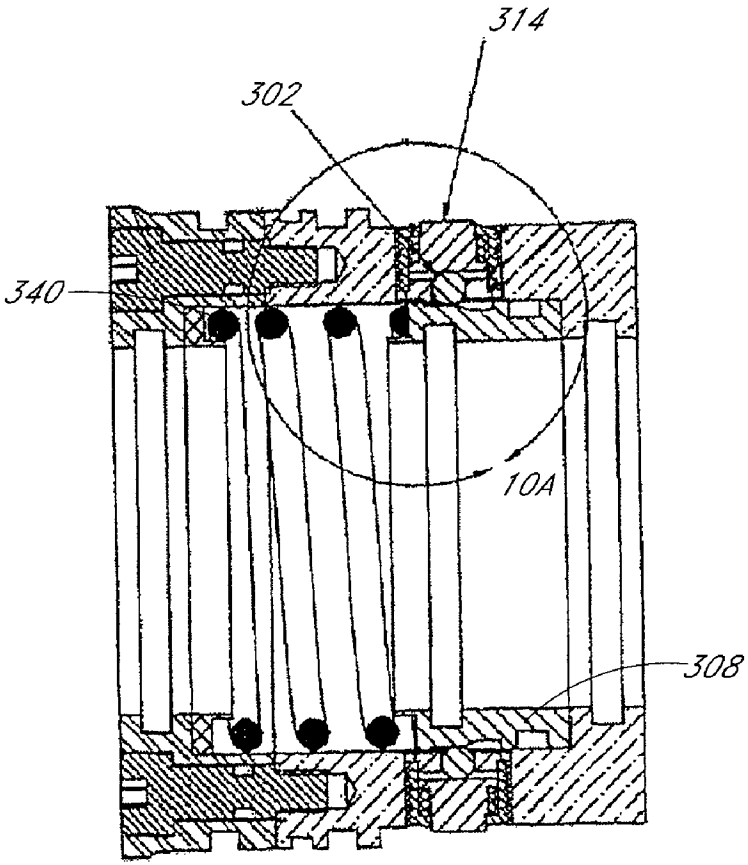
FIG. 10 is a cross-sectional view of one embodiment of a locking mechanism in an engaged position for preventing unwanted expansion of the gripper mechanism.
Figure 10A:
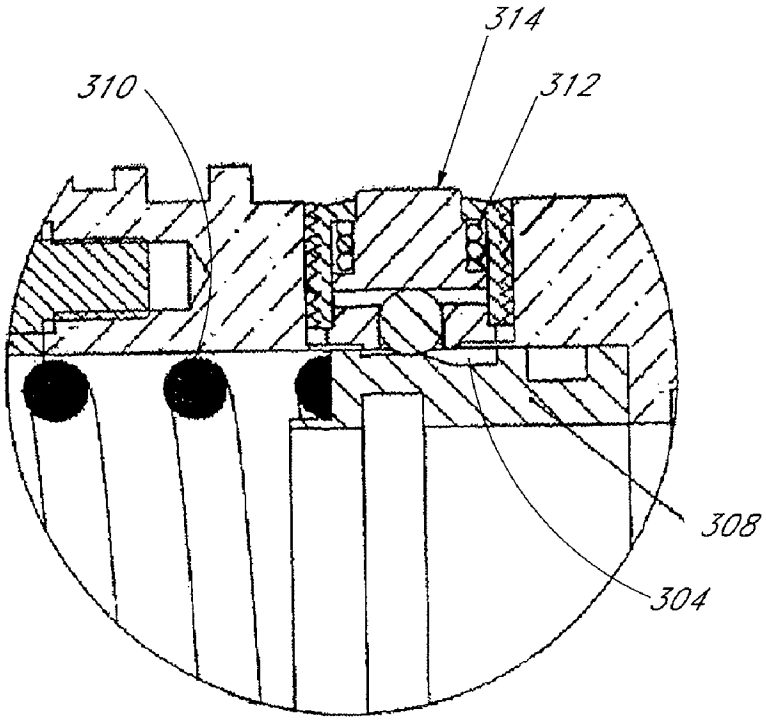
FIG. 10A is a detail view of the locking mechanism as depicted in FIG. 10.
Figure 11A:
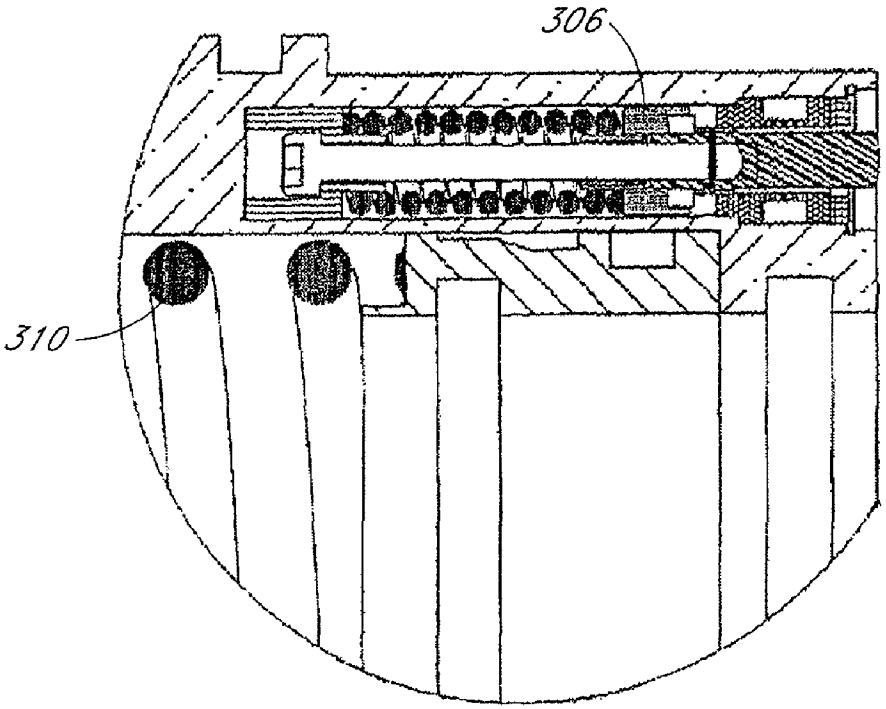
FIG. 11A is a detail view of the locking mechanism as depicted in FIG. 11.
Figure 11:
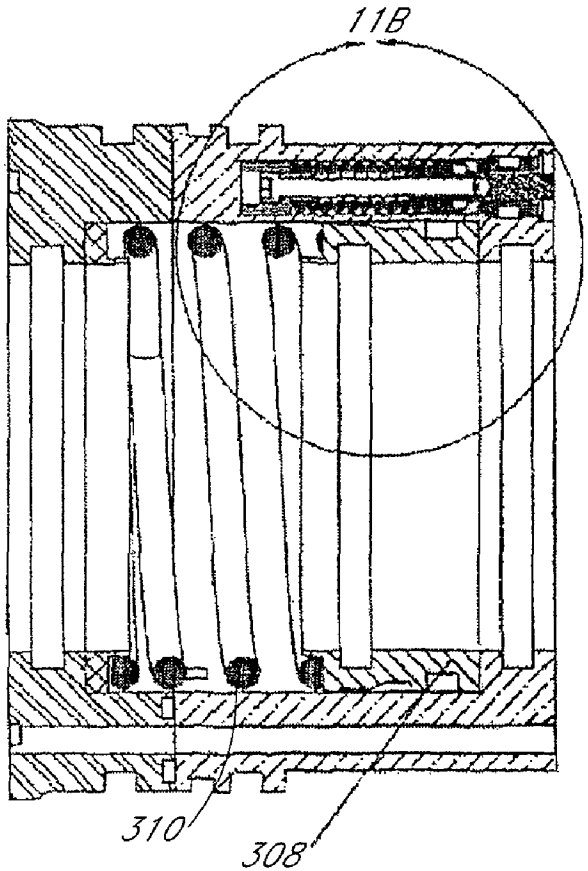
FIG. 11 is a cross-sectional view of the locking mechanism of FIG. 10 in an engaged position depicting its poppet valve.

FIGS. 8 and 9 illustrate various configurations of an inclined ramp 126 of the above-described gripper assembly. As shown, the ramp can have a varying angle of inclination $\alpha$ with respect to the mandrel 102. The radial component of the force transmitted between the roller 132 and the ramp 126 is proportional to the sine of the angle of inclination α of the section of the ramp that the roller is in contact with. With respect to the expandable gripper assembly 100 depicted, at the inner radial level 128, the ramp 126 has a non-zero angle of inclination α. Thus, when the gripper assembly begins to move from its retracted position to its actuated position, it is capable of transmitting significant radial load to the borehole surface. In small diameter boreholes, in which the gripper assembly 100 is displaced only slightly before coming into contact with the borehole surface, the angle α can be chosen so that the gripper assembly provides relatively greater radial load.

The ramp 126 can be shaped to have a varying or non-varying angle of inclination α with respect to the mandrel 102. FIGS. 8 and 9 illustrate ramps 126 of different shapes. The shape of the ramp 126 may be modified as desired to suit the particular size of the borehole and the compression strength of the formation. Those of skill in the art will understand that the different ramps 126 of a single gripper assembly 100 may have different shapes. However, it is preferred that they have generally the same shape, so that the toe links 164 of a single gripper assembly 100 are radially displaced at a more uniform rate.

FIGS. 8 and 9 show different embodiments of the ramps 126, roller 132, and roller sleeve 114 elements of the gripper assembly 100 shown in FIGS. 3-8. FIG. 8 shows an embodiment having a ramp 126 with an inclination angle that varies over a length of the ramp. The ramp as shown in FIG. 8 is convex with respect to the roller 132 and the roller link 160. This embodiment provides relatively faster initial radial displacement of the gripper assembly 100 caused by forward motion of the roller sleeve 114. In addition, since the angle of inclination α of the ramp 126 at its inner radial level 128 is relatively high, the expandable gripper assembly 100 transmits relatively high radial loads to the borehole when the expandable gripper assembly 100 is only slightly radially displaced. In this embodiment, the rate of radial displacement of the expandable gripper assembly 100 is initially high and then decreases as the roller sleeve 114 moves forward. FIG. 9 shows an embodiment having a ramp with a uniform angle of inclination α. In comparison to the embodiment of FIG. 8, this embodiment provides relatively slower initial radial displacement of the gripper assembly 100 caused by forward motion of the roller sleeve 114. Also, since the angle of inclination α of the ramp 126 at its inner radial level 128 is relatively lower, the gripper assembly 100 transmits relatively lower radial loads to the borehole when the gripper assemblies 100 are only slightly radially displaced. In this embodiment, the rate of radial displacement of the gripper assembly 100 remains constant as the roller sleeve 114 moves forward.

In addition to the embodiments shown in FIGS. 8 and 9, the ramp 126 may alternatively be concave with respect to the roller 132 and the roller link 160. Also, many other configurations are possible. The inclination angle α can be varied such that the toe link 164 (FIG. 3) generates an approximately uniform radial force while the roller 132 is rotatably engaged with the ramp 126. The approximately uniform radial force is the resultant force produced resulting from the angle α and the varying lever arm length roller link 160. The angle α can be varied as desired to control the mechanical advantage wedging force of the ramp 126 over a specific range of radial expansion of the gripper assembly 100. Preferably, at the inner radial positions 128 of the ramps 126, α is within the range of 1° to 45°. Preferably, at the outer radial positions 130 of the ramps 126, α is within the range of 0° to 30°. For the embodiment of FIG. 8, α is preferably approximately 30° at the inner radial position 130.

At larger radial expansions of the expandable gripper assembly 100, the roller 132 may depart the ramp 126 surface, and the longitudinal fluid pressure force of the second piston 238 on the toggle sleeve 214 primarily contributes to the radial force applied at the toe link 164. As discussed above with respect to prior art four-bar linkages, the radial component of the transmitted force is proportional to the sine of an angle between the toggle link 162 and the mandrel 102. Since the roller 132 does not separate from the ramp 126 until larger radial expansions of the gripper assembly 100, the angle between the toggle link 162 and the mandrel is sufficiently large to allow a significant transmission of radial force to the inner wall of the passage.

By transmitting radial force primarily through a roller 132 to ramp 126 interface at smaller radial expansions, then primarily through longitudinal force on the toggle link 162 at larger radial expansions, the expandable gripper assembly is preferably configured to generate a radial force of at least 1000 pounds at any radial expansion of the expandable gripper assembly that would engage a substantially cylindrical segment having an inner diameter ranging between about 3½ inches and 8½ inches. Alternately, the expandable gripper assembly may be configured to generate a radial force of at least 300 pounds at any radial expansion of the expandable gripper assembly that would engage a substantially cylindrical segment having an inner diameter ranging between about 2⅞ inches and 12½ inches. An expandable gripper assembly configured to exert such a radial force could be used in conjunction with a tool for use in downhole operations as described above. In conjunction with the tool, the expandable gripper assembly would be capable of applying the at least about 1000 pounds of force to an inner wall of a passage having any inner diameter ranging from about 3½ inches to 8½ inches (or, in the alternate embodiment, at least about 300 pounds for an inner diameter ranging from about 2⅞ inches to 12½ inches) to anchor a propulsion system of the tool in a passage while a longitudinally movable elongate body of the tool is advanced through the passage.

Locking Mechanism

In certain embodiments, an expandable assembly of the present invention further comprises a locking mechanism. The locking mechanism selectively prevents the second actuation assembly 218 from moving and thereby prevents self-energizing of the expandable gripper assembly. Without such a locking mechanism, a self-energizing failure could be encountered when the retracted expandable gripper assembly is slid through debris or a restriction in the well bore. Such an encounter could expand the gripper assembly and create the risk that the expanded gripper assembly, and an attached tractor, would become stuck in a passage.

One embodiment of locking mechanism is depicted in FIGS. 10-13. As depicted, this locking mechanism is a ball lock mechanism. The function of the ball lock mechanism is to captivate the second piston 238 (FIG. 6). The ball lock mechanism comprises a ball 302 configured to fit in a recess 304 in a locking piston 308 of the second actuation assembly 218, a poppet valve 306, a piston spring 310, a lock spring 312, and a lock 314. Since the second piston 238 (FIG. 6) is directly connected to the expandable gripper assembly 100 (FIG. 6), the second piston 238 (FIG. 6) could move if the toe link 164 was forced radially outward accidentally. FIG. 10, 10A, 11 and 11A illustrate the ball lock mechanism in an engaged position for preventing unwanted movement of the expandable gripper assembly. FIGS. 12, 12A, 13, and 13A illustrate the ball lock mechanism in an disengaged position for allowing actuation of the expandable gripper assembly.

The ball lock mechanism may be activated by the position of the toggle piston 238 and the available pressure to the second piston 238. While the expandable gripper assembly is retracted (FIGS. 3, 3A, and 10), the second piston 238 is seated against the face of the ball lock mechanism. In this position, the poppet valve 306 is depressed (open) and the locking piston 308 is vented. In this position, the ball 302 is forced upwards on the ramp of the locking piston 308. This action collapses the lock spring 312 and forces the lock 314 radially outward and into a lock groove of the second piston 238.

In operation of the illustrated ball lock mechanism, when the expandable gripper is pressurized, a sequence of actions occurs to unlock the ball lock mechanism and then energize the gripper. Initially, the fluid pressure acts on the locking piston 308 forcing it against the piston spring 310 into the disengaged or unlocked position (FIGS. 12, 12A, 13, 13A). This movement of the locking piston allows the ball 302 to fall into the recess 304 and the lock 314 is forced radially inward by the lock spring 312. This process "unlocks" the ball lock mechanism.

Figure 12:
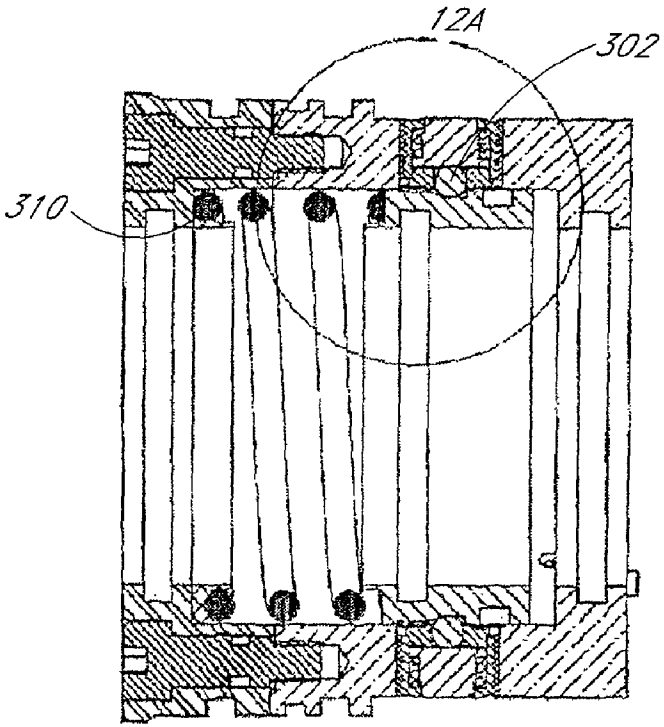
FIG. 12 is a cross-sectional view of the locking mechanism of FIG. 10 in a disengaged position depicting its poppet valve.
Figure 12A:
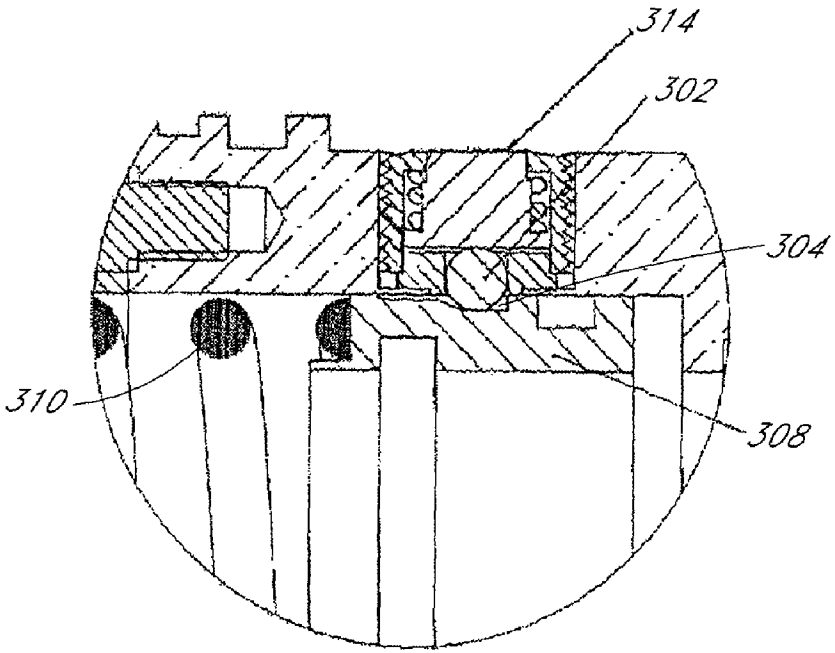
FIG. 12A is a detail view of the locking mechanism as depicted in FIG. 12.
Figure 13A:
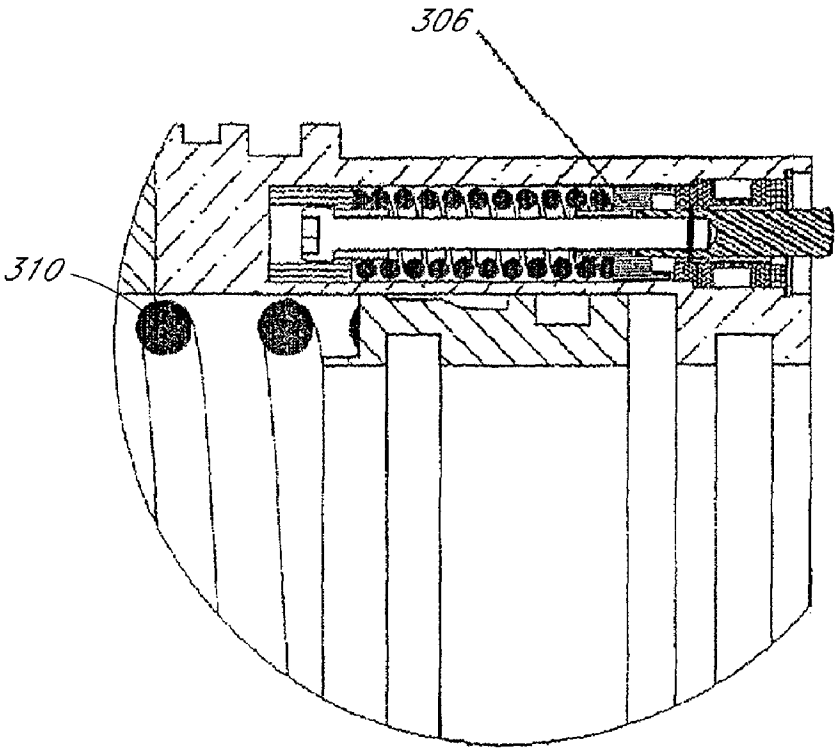
FIG. 13A is a detail view of the locking mechanism as depicted in FIG. 13.
Figure 13:
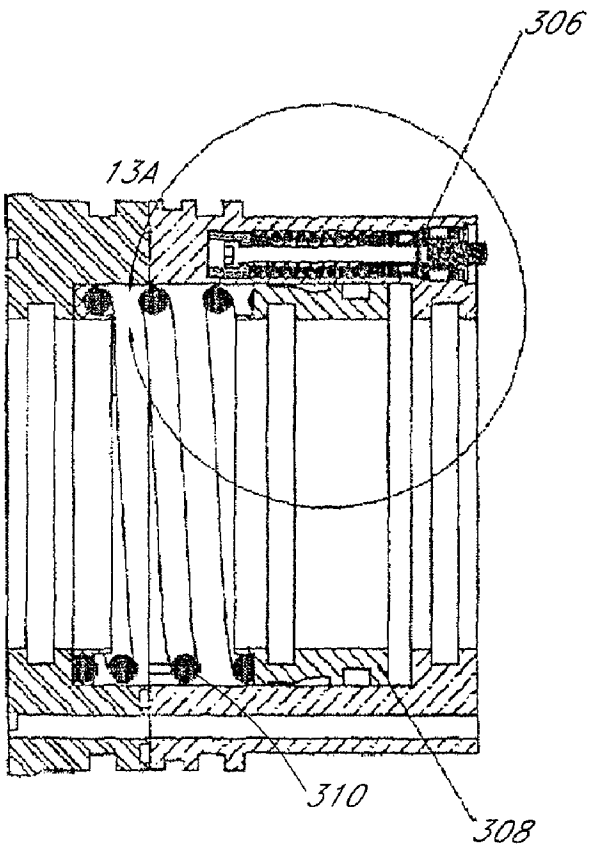
FIG. 13 is a cross-sectional view of the locking mechanism of FIG. 10 in a disengaged position depicting its ball lock.
Figure 14:
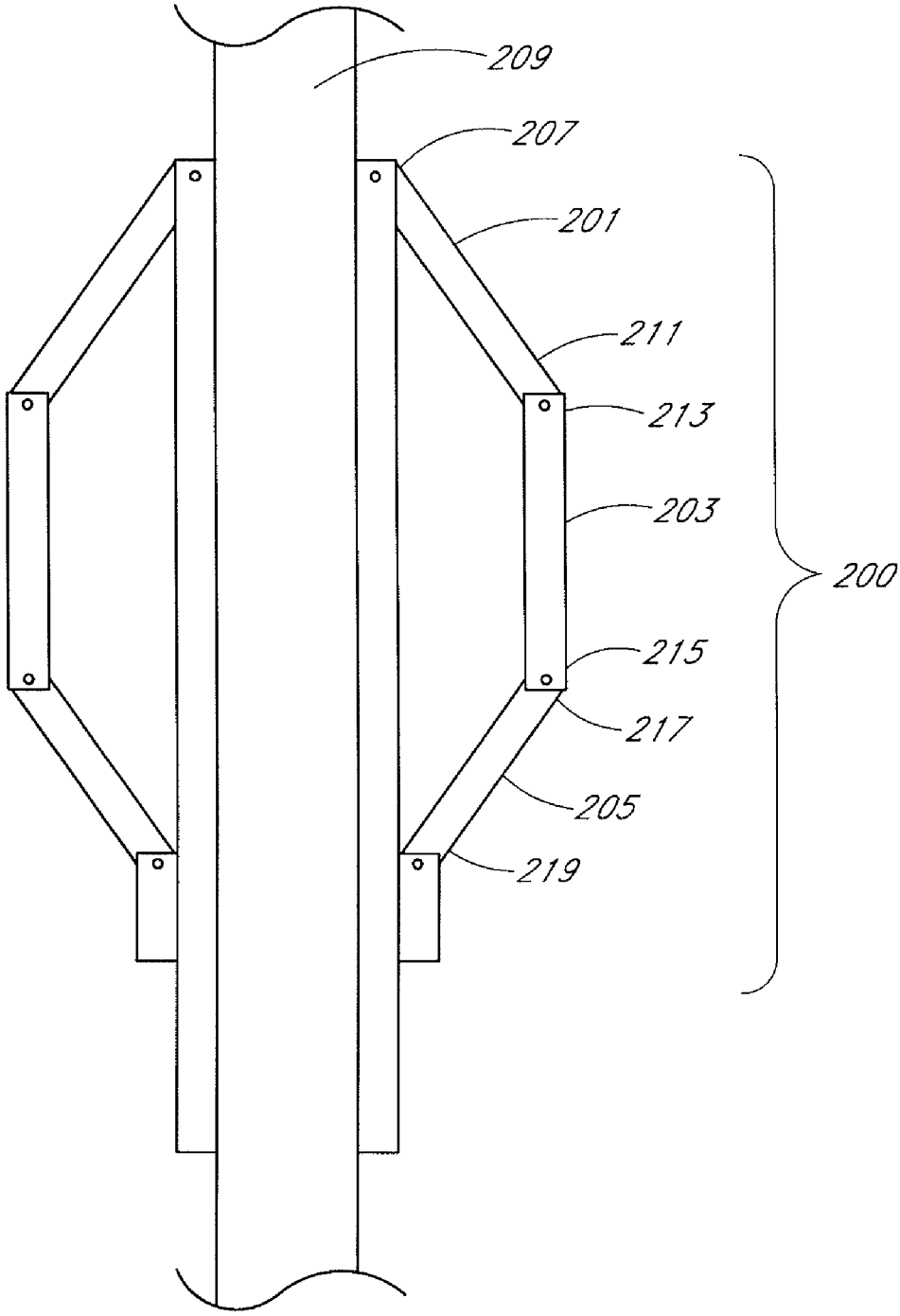
FIG. 14 (PRIOR ART)
FIG. 14 is a schematic diagram illustrating a four-bar linkage gripper of the prior art.

As the second piston 238 moves longitudinally, the poppet valve 306 closes (FIGS. 13, 13A) and hydraulically locks the ball lock mechanism in the disengaged position (FIGS. 12, 12A). The ball lock mechanism stays in this disengaged position until the second piston 238 physically depresses the poppet valve 306 to vent the locking piston 308.

In addition, an alternative feature includes using the locking piston 308 as a sequencing valve. In one embodiment, the locking piston 308 advantageously physically interferes with fluid passages through a lock hub 320 and restricts fluid flow to the second piston 238 (FIG. 6). The fluid flow would be directed to the poppet valve 306 and into the locking piston 308 chamber. As the locking piston 308 strokes out, the fluid passages would open the fluid flow to the second piston 238 chamber. Advantageously, expandable gripper assemblies of the present invention featuring a locking mechanism such as is described above would be unlikely to suffer from a self-energizing failure.

Materials for the Gripper Assemblies

The above-described gripper assemblies may utilize several different materials. Certain tractors may use magnetic sensors, such as magnetometers for measuring displacement. In such tractors, it is preferred to use non-magnetic materials to minimize any interference with the operation of the sensors. In other tractors, it may be preferred to use magnetic materials.

In the gripper assemblies described above, the first, second, and third links 160, 162, and 164 are preferably made of materials that are not chemically reactive in the presence of water, diesel oil, or other downhole fluids. Also, the materials are preferably abrasion and fretting resistant and have high compressive strength (80-200 ksi). Non-magnetic candidate materials for the links 160, 162, and 164 include copper-beryllium, Inconel, and suitable titanium or titanium alloy. Other candidate materials include steel, tungsten carbide infiltrates, nickel steels and others. The links 160, 162, and 164 may be coated with materials to prevent wear and decrease fretting or galling, such as various plasma spray coatings of tungsten carbide, titanium carbide, and similar materials. Such coatings can be sprayed or otherwise applied (e.g., EB welded or diffusion bonded) to the links 160, 162, and 164.

Testing has demonstrated that the coating of the mandrel with Nickel-Thallium-Boron coating is advantageous because this material is wear resistant and does not react to chlorides that are commonly found in intervention fluids and drilling fluids. In addition, corrosion resistance of Inconel alloys and Copper-Beryllium alloy is desirable for resisting downhole acids and hydrogen sulfide gas. Alternatively, testing has shown that the commercial product Tech 23 from Bodycote K-tech has long operational life, physical toughness, resistance to impact, resistance to acid and chlorides, and long wear life. Also, requirements for high strength materials for the springs may work well with MP35N alloy.

The gripping surface of the gripper assembly 100 may be equipped with additional friction enhancers. For example, for operation in new or slick casing, tungsten carbide inserts may be placed on the toe link 164 to improve gripping. Experiments have shown that through the use of tungsten carbide inserts, the Coefficient of Friction may be increased for 0.18 (metal on lubricated casing) to 0.5+ (tungsten carbide inserts on slick casing). This dramatic increase can be of significant importance for a gripper assembly of the present invention carrying heavy loads to a specific location in the well.

The mandrel 102, mandrel caps 104 and 110, piston rods 124, 224, and cylinders 108, 208 are preferably made of high strength magnetic metals such as steel or stainless steel, or non-magnetic materials such as copper-beryllium or titanium. The first and second return springs 144, 244 are preferably made of stainless steel that may be cold set to achieve proper spring characteristics. The roller 132 is preferably made of copper-beryllium. The axle of the roller 132 is preferably made of a high strength material such as MP-35N alloy. The seals to fit in grooves 143, 243 for each corresponding piston 138, 238 can be formed from various types of materials, but is preferably compatible with the drilling fluids. Examples of acceptable seal materials that are compatible with some drilling muds include HNBR, Viton, and Aflas, among others. The first and second pistons 138, 238 are preferably compatible with drilling fluids. Candidate materials for the pistons 138, 238 include high strength, long life, and corrosion-resistant materials such as copper beryllium alloys, nickel alloys, nickel-cobalt-chromium alloys, and others. In addition, the first and second pistons 138, 238 may be formed of steel, stainless steel, copper-beryllium, titanium, Teflon-like material, and other materials. Portions of the gripper assembly may be coated. For example the first and second piston rods 124, 224 and the mandrel 102 may be coated with chrome, nickel, multiple coatings of nickel and chrome, or other suitable abrasion resistant materials.

The inner surface 127 of the first link 160 forming the ramp 126 (FIG. 8) is preferably made of copper-beryllium. Endurance tests of copper-beryllium ramp materials with copper-beryllium rollers in the presence of drilling mud have demonstrated life beyond 10,000 cycles. Similar tests of copper-beryllium ramps with copper-beryllium rollers operating in air have shown life greater than 32,000 cycles.

A preferred embodiment of the present invention utilizes cap type seals with seal caps composed of 55% bronze, 5% molyedeum filled Teflon with expanders made of HNBR rubber with anti-extrusion rings of 30% carbon filled PEEK. Wear guides may be made of 30% carbon filled PEEK. Alternatively, other materials with the desired chemical resistance, wear life, and chemical compatibility may be used.

Performance

Many of the performance capabilities of the above-described gripper assemblies will depend on their physical and geometric characteristics. With specific regard to the expandable gripper assembly 100, the assembly can be adjusted to meet the requirements of gripping force and torque resistance. In one embodiment, the gripper assembly has a diameter of 4.40 inches in the retracted position and is approximately 42 inches long. This embodiment can be operated with fluid pressurized up to 2000 psi, can provide up to 10,000 pounds of gripping force, and can resist up to 1000 foot-pounds of torque without slippage between the expandable gripper assembly 100 and the borehole surface. In this embodiment, the gripper assembly 100 is designed to withstand approximately 50,000 cycles without failure.

The gripper assembly 100 of the present invention can be configured to operate over a range of diameters. In the above-mentioned embodiment of the gripper assemblies 100 having a collapsed diameter of 3.125 inches, the grippers 112 can expand radially so that the assembly has a diameter of 7.5 inches. Other configurations of the design can have expansion up to 12.5 inches. It is expected that by varying the size of the links 160, 162, and 164, a practical range for the gripper is 3.0 to 13.375 inches.

The size of gripping surfaces of the gripper assembly 100 can be varied to suit the compressive strength of the earth formation through which the tractor moves. For example, wider toe links 164 may be desired in softer formations, such as "gumbo" shale of the Gulf of Mexico. The number of grippers 112 comprising each gripper assembly 100 can also be altered to meet specific requirement for "flow-by" of the returning drilling fluid. In a preferred embodiment, three grippers 112 are provided, which assures that the loads will be distributed to three contact points on the borehole surface. In comparison, a configuration with four grippers 112 could result in only two points of contact in oval-shaped passages. Testing has demonstrated that the preferred configuration can safely operate in shales with compressive strengths as low as 500 psi. Alternative configurations can operate in shale with compressive strength as low as 250 psi.

The pressure compensation and lubrication system described herein provides significant advantages. Experimental tests were conducted with various configurations of rollers 132, rolling surfaces, axles, and coatings. One experiment used copper-beryllium rollers 132 and MP-35N axles. The axles and journals (i.e., the ends of the axles) were coated with NPI425. The rollers 132 were rolled against copper-beryllium plate while the rollers 132 were submerged in drilling mud. In this experiment, however, the axles and journals were not submerged in the mud. Under these conditions, the roller assembly sustained over 10,004 cycles without failure. A similar test used copper-beryllium rollers 132 and MP-35N axles coated with Dicronite. The rollers 132 were rolled against copper-beryllium plate. In this experiment, the axles, rollers 132, and journals were submerged in drilling mud. The roller assembly failed after only 250 cycles. Hence, experimental data suggests that the presence of drilling mud on the axles and journals dramatically reduces operational life. By preventing contact between the drilling fluid and the axles and journals, the pressure compensation and lubrication system contributes to a longer life of the gripper assembly.

The metallic links 160, 162, and 164 formed of copper-beryllium have a very long fatigue life compared to prior art gripper assemblies. The fatigue life of the links 160, 162, and 164 is greater than 50,000 cycles, producing greater downhole operational life of the gripper assembly. Further, the shape of the links 160, 162, and 164 provides very little resistance to flow-by, i.e., drilling fluid returning from the drill bit up through the annulus 40 (FIG. 1) between the tractor and the borehole. Advantageously, the design of the gripper assembly allows returning drilling fluid to easily pass the gripper assembly without excessive pressure drop. Further, the gripper assembly does not significantly cause drill cuttings in the returning fluid to drop out of the main fluid path. Drilling experiments in test formations containing significant amounts of small diameter gravel have shown that deactivation of the gripper assembly clears the gripper assembly of built-up debris and allows further drilling.

Another advantage of the gripper assemblies of the present invention is that they provide relatively uniform borehole wall gripping. The gripping force is proportional to the actuation fluid pressure. Thus, at higher operating pressures, the gripper assemblies will grip the borehole wall more tightly.

In summary, the gripper assemblies of various embodiments of the present invention provide significant utility and advantage. They are relatively easy to manufacture and install onto a variety of different types of tractors. They are capable of exerting a significant radial force over a wide range of expansion from their retracted to their actuated positions. They can be actuated with little production of sliding friction, and thus are capable of transmitting larger radial loads onto a borehole surface. They permit rapid actuation and retraction, and can safely and reliably disengage from the inner surface of a passage without getting stuck. They effectively resist contamination from drilling fluids and other sources. They are able to operate in harsh downhole conditions, including pressures as high as 16,000 psi and temperatures as high as 300° F. They are able to simultaneously resist thrusting or drag forces as well as torque from drilling, and have a long fatigue life under combined loads. They may be equipped with a locking mechanism that prevents self-energizing failure. They have a very cost-effective life, estimated to be at least 100-150 hours of downhole operation. They can be immediately installed onto existing tractors without retrofitting.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A method of gripping a surrounding surface with an expandable assembly for use with a tractor for moving within a passage, said expandable assembly configured to be longitudinally movably engaged with an elongated shaft of said tractor, said expandable assembly comprising a first link, a second link, a wall engaging member, a roller and a ramp, the first and second links being pivotally attached relative to the elongated shaft at respective first ends and being connected with the wall engaging member at respective second ends, the roller and ramp being positioned such that the roller engages the ramp during at least a portion of a range of expansion of the expandable assembly, the method comprising the steps of:

advancing the first end of the second link toward the first end of the first link such that the expandable assembly expands radially outwardly relative to the elongated shaft;

fixing the first end of the first link against longitudinal movement along the elongated shaft of said tractor;

engaging the surrounding surface with the wall engaging member under the influence of the expanding expandable assembly;

after fixing the first end of the first link against longitudinal movement along the elongated shaft of said tractor, advancing the roller over at least a portion of the ramp such that a radially-outward force is applied to the wall engaging member.

2. The method of claim 1, further comprising the step of advancing the first end of the second link toward the first end of the first link a sufficient distance that the roller disengages the ramp.

3. The method of claim 2, wherein the wall engaging member engages the surrounding surfaces after the roller disengages the ramp.

4. The method of claim 1, wherein the first end of the second link is advanced toward the first end of the first link while the roller is advanced over the ramp.

5. The method of claim 1, wherein roller is advanced over the ramp in a direction toward the fixed first end of the first link.

6. The method of claim 1, further comprising the step of retracting the expandable assembly such that the wall engaging portion disengages the surrounding surface.

7. The method of claim 6, wherein retracting the expandable assembly comprises retraction of the roller relative to the ramp.

* * * * *